US006389868B2

(12) United States Patent
Nagao et al.

(10) Patent No.: US 6,389,868 B2
(45) Date of Patent: May 21, 2002

(54) FORGING DIE INCORPORATED WITH A FORGING APPARATUS

(75) Inventors: Yuichi Nagao, Omiya; Takeshi Tatsumi, Tochigi-ken; Yoshihisa Doi, Utsunomiya, all of (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/779,739

(22) Filed: Feb. 9, 2001

Related U.S. Application Data

(62) Division of application No. 09/379,893, filed on Aug. 24, 1999, now Pat. No. 6,205,828.

(30) Foreign Application Priority Data

| | | |
|---|---|---|
| Aug. 24, 1998 | (JP) | 10-237614 |
| Sep. 2, 1998 | (JP) | 10-248463 |
| Sep. 2, 1998 | (JP) | 10-248468 |
| Sep. 7, 1998 | (JP) | 10-252854 |
| Sep. 11, 1998 | (JP) | 10-258668 |

(51) Int. Cl.[7] ..... B21J 13/02
(52) U.S. Cl. ..... 72/359; 72/478
(58) Field of Search ..... 72/344, 352, 354.6, 72/359, 470, 478, 358

(56) References Cited

U.S. PATENT DOCUMENTS

| | | | | |
|---|---|---|---|---|
| 2,080,399 A | * | 5/1937 | Deibel | 72/478 |
| 3,280,613 A | * | 10/1966 | Schrom | 72/359 |
| 3,444,719 A | * | 5/1969 | Roehrs | 72/352 |
| 4,304,115 A | * | 12/1981 | Martin | 72/359 |
| 5,220,820 A | | 6/1993 | Terrell et al. | |
| 5,339,665 A | | 8/1994 | Yoshikawa | |
| 5,673,601 A | | 10/1997 | Ejima et al. | |
| 5,823,104 A | | 10/1998 | Beisel et al. | |
| 5,966,981 A | | 10/1999 | Janos et al. | |
| 5,979,210 A | | 11/1999 | Baur et al. | |

FOREIGN PATENT DOCUMENTS

| | | |
|---|---|---|
| JP | 11169996 | 6/1999 |

* cited by examiner

*Primary Examiner*—Lowell A. Larson
(74) *Attorney, Agent, or Firm*—Birch, Stewart, Kolasch & Birch, LLP

(57) ABSTRACT

A hydraulic pressure control apparatus comprises a high pressure accumulator for sucking pressure oil supplied to a relief chamber of a relief valve to make changeover for the relief valve from a valve-closed state to a valve-open state when a forming load is applied to the pressure oil charged in a pressure chamber and the hydraulic pressure of the pressure oil arrives at a relief preset pressure, and a low pressure accumulator for sucking the pressure oil charged in the pressure chamber via the relief valve which is in the valve-open state.

7 Claims, 28 Drawing Sheets

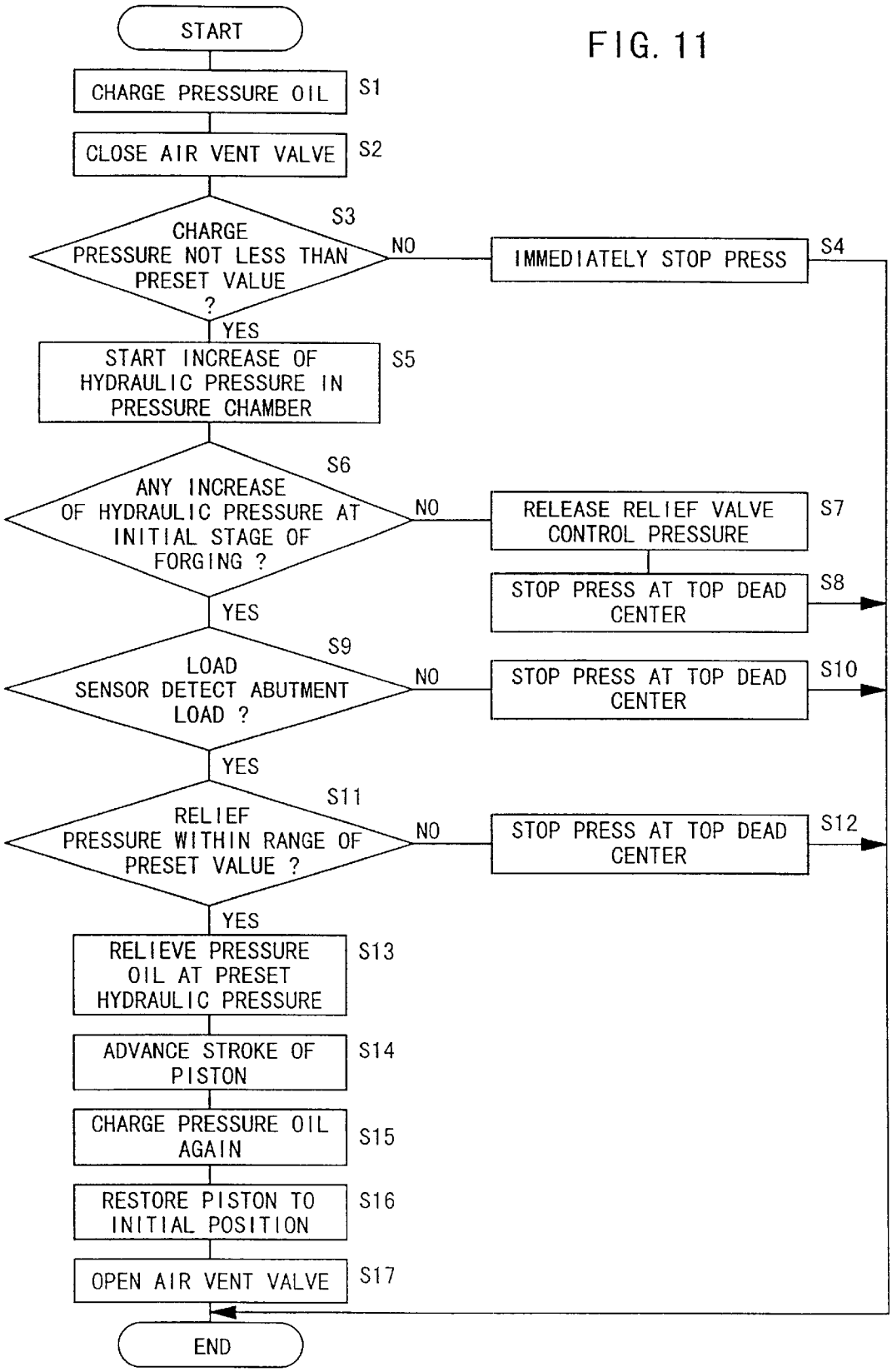
FIG. 11
START
CHARGE PRESSURE OIL
S1
CLOSE AIR VENT VALVE
S2
S3
CHARGE PRESSURE NOT LESS THAN PRESET VALUE ?
NO
IMMEDIATELY STOP PRESS
S4
YES
START INCREASE OF HYDRAULIC PRESSURE IN PRESSURE CHAMBER
S5
S6
ANY INCREASE OF HYDRAULIC PRESSURE AT INITIAL STAGE OF FORGING ?
NO
RELEASE RELIEF VALVE CONTROL PRESSURE
S7
STOP PRESS AT TOP DEAD CENTER
S8
YES
S9
LOAD SENSOR DETECT ABUTMENT LOAD ?
NO
STOP PRESS AT TOP DEAD CENTER
S10
YES
S11
RELIEF PRESSURE WITHIN RANGE OF PRESET VALUE ?
NO
STOP PRESS AT TOP DEAD CENTER
S12
YES
RELIEVE PRESSURE OIL AT PRESET HYDRAULIC PRESSURE
S13
ADVANCE STROKE OF PISTON
S14
CHARGE PRESSURE OIL AGAIN
S15
RESTORE PISTON TO INITIAL POSITION
S16
OPEN AIR VENT VALVE
S17
END

FORGING DIE INCORPORATED WITH A FORGING APPARATUS

This application is a divisional application Ser. No. 09/379,893, filed on Aug. 24, 1999, now U.S. Pat. No. 6,205,828, the entire contents of which are hereby incorporated by reference and for which priority is claimed under 35 U.S.C. § 120; and this application claims priority of Application Nos. 10-237614; 10-248463; 10-248468; 10-252854; and 10-258668 filed in Japan on Aug. 24, 1998; Sep. 2, 1998; Sep. 2, 1998; Sep. 7, 1998; and Sep. 11, 1999, respectively, under 35 U.S.C. § 119.

BACKGROUND OF THE INVENTION

1. Field of the Invention

The present invention relates to a forging die, and a method and an apparatus for controlling the same, in which a forging material is arranged in a cavity so that it may be forged in accordance with a pressurizing action of a punch.

2. Description of the Related Art

A forging die has been hitherto known, which is used to forge a forging material into a predetermined shape such that the forging material is inserted into a cavity which is formed by an upper die and a lower die joined to one another, and a pressurizing force is applied to the forging material by the aid of a punch.

The present applicant has suggested a forging die which is provided with a buffering mechanism for absorbing a residual displacement amount corresponding to a range from abutment of a punch against a lower die to arrival at a bottom dead center (Japanese Laid-open Patent Publication No. 11-169996).

The buffering mechanism includes a piston which is provided displaceably along a pressure chamber charged with a pressure oil. The buffering mechanism functions to preferably absorb the residual displacement amount of the punch by using the pressure oil charged in the pressure chamber in accordance with a displacement action of the piston.

SUMMARY OF THE INVENTION

A general object of the present invention is to provide a method and an apparatus for controlling a forging die, in which a high pressure is applied without generating any surge pressure, and a buffering function is preferably effected to absorb the forming load by using a pressure fluid having a high discharge speed.

A principal object of the present invention is to provide a method and an apparatus for controlling a forging die, in which if no forging material is charged in a cavity, the die is prevented from any damage even when an upper die and a lower die make abutment so that the durability of the die is improved.

Another object of the present invention is to provide a forging die, in which any strain of the die due to any stress is reduced to improve the durability of the die, and the cost of the die is lowered.

Still another object of the present invention is to provide a forging die, in which the die is allowed to have a simplified structure to improve the dividability, and the number of parts to be exchanged due to secular change is made as small as possible so that the cost may be reduced.

Still another object of the present invention is to provide a forging die, in which any stress concentration, which would be otherwise caused by tensioning, is suppressed to improve the durability of the die, and thus the cost of the die can be lowered.

The above and other objects, features, and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIG. 11 shows a flow chart illustrating the operation of the hydraulic pressure control apparatus according to the first embodiment;

DESCRIPTION OF THE PREFERRED EMBODIMENTS

Figure 1:
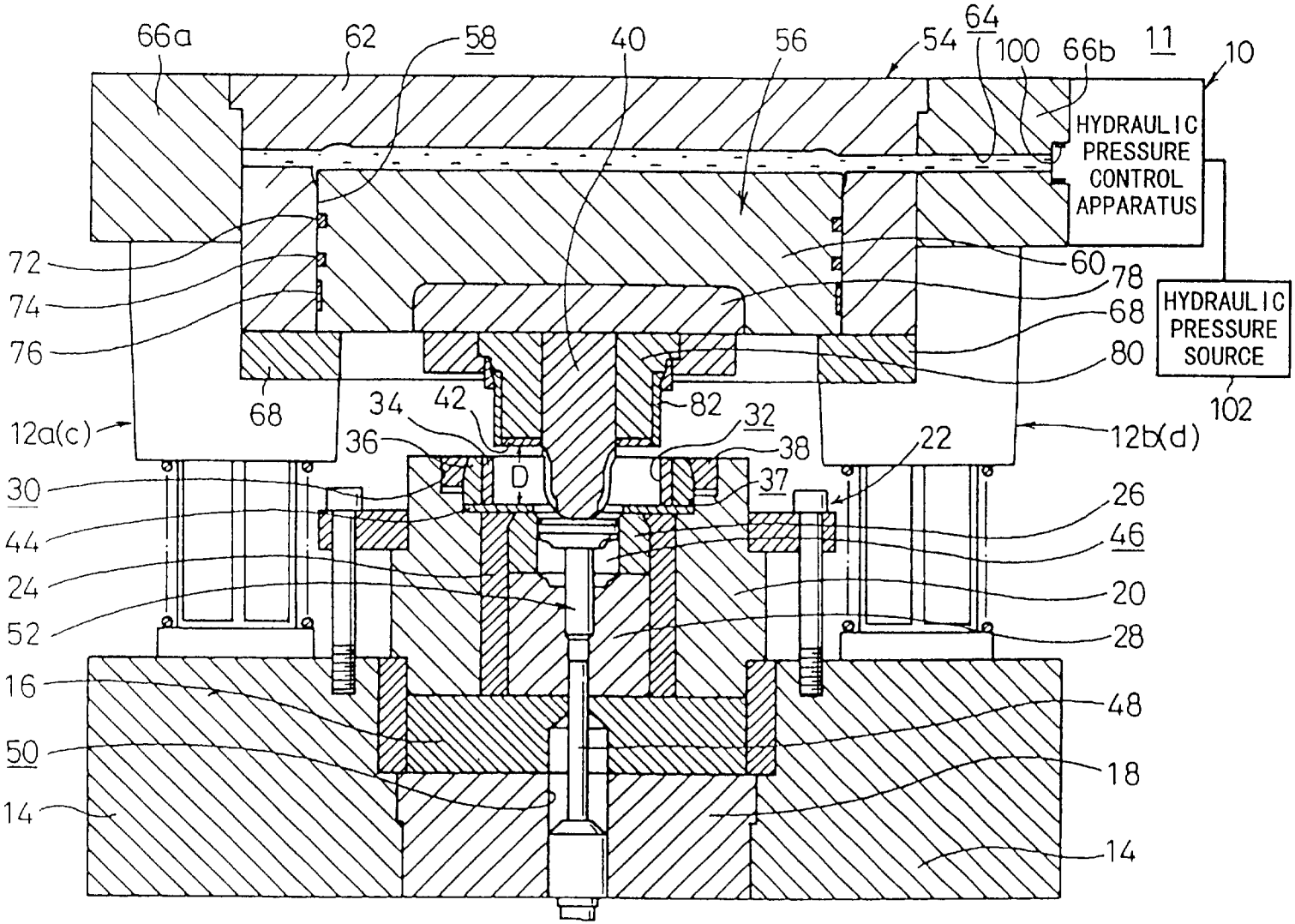
FIG. 1 shows a longitudinal sectional view illustrating a forging die incorporated with a hydraulic pressure control apparatus according to a first embodiment of the present invention.

With reference to FIG. 1, reference numeral 11 indicates a forging die which is incorporated with a hydraulic pressure control apparatus 10 according to a first embodiment of the present invention.

The forging die 11 comprises a first die holder 14 which is provided with a plurality of guide means 12*a* to 12*d* standing thereon in the vicinity of four corners, and a second die holder 16 and a third die holder 18 which are provided in a stacked manner at a central portion of the first die holder 14.

A thick-walled forcible insertion ring 20, which is formed in an integrated manner, is fixed on the second die holder 16 by the aid of a clamping means 22. An upper die 26 and a lower die 28 are joined in an integrated manner in a hole of the forcible insertion ring 20 by the aid of a sleeve 24 which is formed to be thin-walled.

A first ring member 34 formed with a hole 32, a second ring member 36 externally fitted to the first ring member 34, and a clamping ring 38 for holding the first ring member 34 and the second ring member 36 are provided in an annular recess 30 which is formed on an upper side of the forcible insertion ring 20. The first ring member 34 and the second ring member 36 are forcibly inserted with good concentricity into a hole 37 which is formed on the upper side of the forcible insertion ring 20 and which is machined concentrically with a cavity 46 as described later on. In this embodiment, the first ring member 34 and the second ring member 36 may be integrally formed as a ring member without constructing them separately with each other.

A first plate 44, which regulates the displacement amount of a punch 40 by making abutment against a second plate 42 that is displaceable integrally with the punch 40 as described later on, is provided on the upper surfaces of the upper die 26 and the sleeve 24. The upper die 26, the lower die 28, and other components including the first plate 44 function as a first die member.

Figure 4:
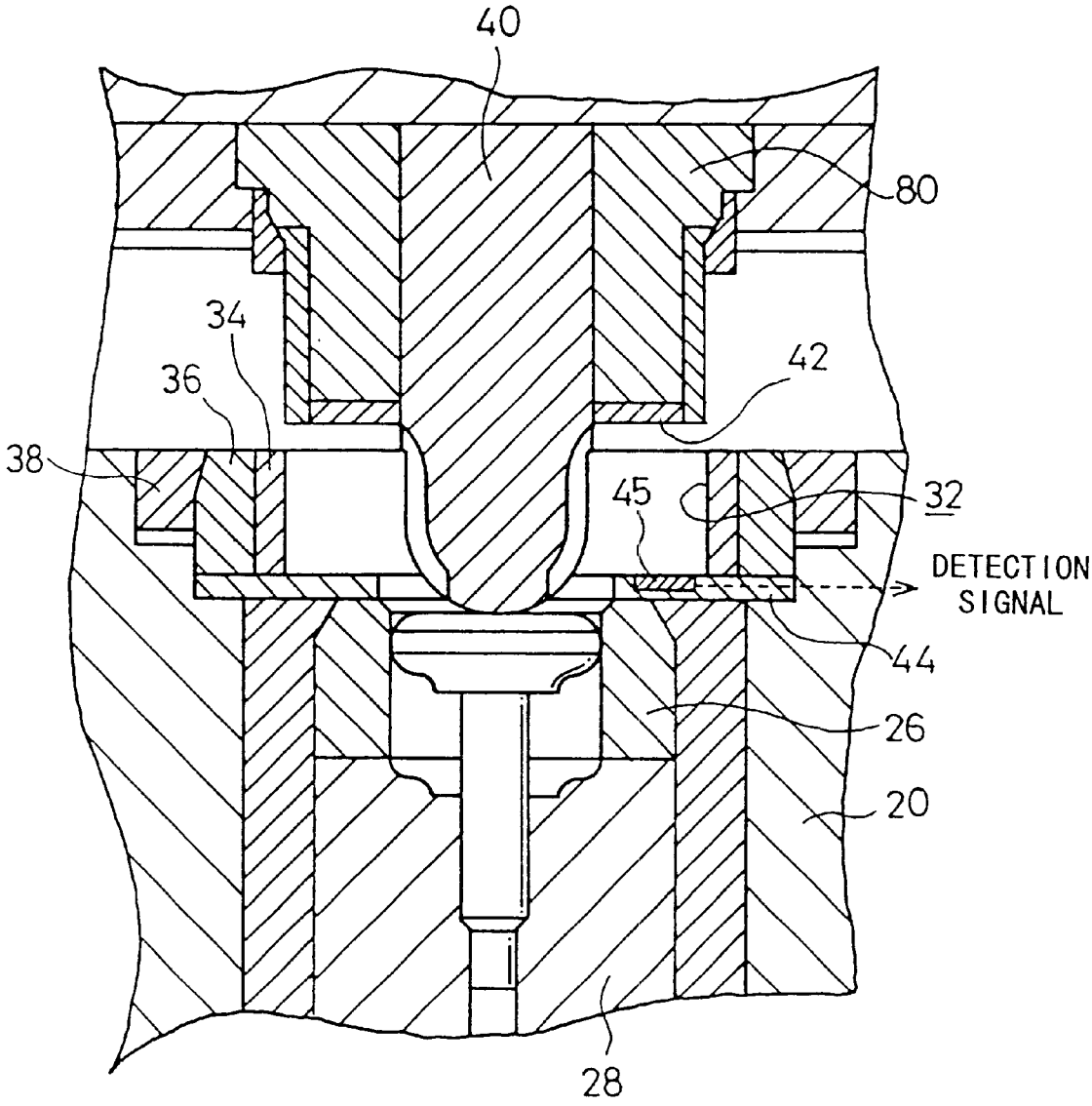
FIG. 4 shows a longitudinal sectional view with partial omission illustrating a state in which a forging material is charged in a cavity.

As shown in FIG. 4, the first plate 44 is provided with a load sensor 45 for detecting whether or not the forming load is reliably applied by the punch 40 to a forging material. In this embodiment, the load sensor 45 is used to detect the fact that the second plate 42, which is displaced integrally with the punch 40, abuts against the first plate 44. A detection signal, which is outputted from the load sensor 45, is introduced into an unillustrated controller. Thus, the controller judges whether or not the first plate 44 and the second plate 42 make abutment to regulate the displacement amount of the punch 40 so that the forging material is forged to have a predetermined thickness dimension.

The first ring member 34 is formed of, for example, a metal material such as cemented carbide. The first ring member 34 is in a state of being strongly tightened toward the center by the second ring member 36 which is subjected to the shrinkage fitting treatment. The first ring member 34 and the second ring member 36 are forcibly inserted into the hole 37 which is machined concentrically with the cavity 46, and they are constricted by a tapered section of the clamping ring 38 which is screwed into the screw hole of the forcible insertion ring 20. Thus, the first ring member 34 and the second ring member 36 are joined in an integrated manner to the recess 30 of the forcible insertion ring 20 with good concentricity.

Figure 8:
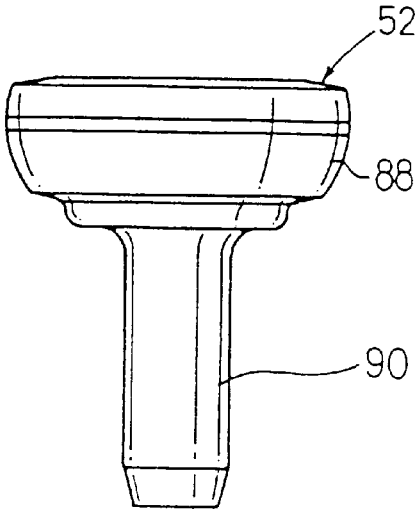
FIG. 8 illustrates a production step of the outer cup for constructing the constant velocity universal joint.

In this embodiment, the cavity 46 is formed by the upper die 26 and the lower die 28. A knockout pin 48 for extruding the forged product is arranged movably back and forth along a hole 50 which is formed through the second die holder 16 and the third die holder 18. A secondary formed product 52 as shown in FIG. 8 is charged as the forging material in the cavity 46.

An elevator unit 54, which is connected to a ram of an unillustrated mechanical press and which is displaceable in the vertical direction integrally with the ram in accordance with the driving action of the mechanical press, is provided over the forcible insertion ring 20 at a position separated by a predetermined distance.

The elevator unit 54 includes a buffering mechanism 56 for absorbing the residual displacement amount until arrival at the bottom dead center after completion of the forging process for the forging material in accordance with the abutment between the upper die and the lower die before arrival at the bottom dead center after the start of the forging process upon the abutment of the punch 40 against the forging material.

The buffering mechanism 56 is formed with a pressure chamber 58 at the inside thereof. The buffering mechanism 56 includes a bottomed cylindrical block member 62 having a piston 60 which is provided vertically displaceably along the pressure chamber 58, and a pair of joint blocks 66*a*, 66*b* connected to the block member 62 in a liquid-tight manner and formed with a passage 64 which communicates with the pressure chamber 58. A ring-shaped stopper 68 for preventing the piston 60 from downward movement is fixed on the bottom surface of the block member 62.

A ring-shaped high pressure packing 72, a low pressure packing 74, and a wear plate 76 are installed to the outer circumference of the piston 60 by the aid of annular grooves. A punch plate 78 is fixed to the bottom surface of the piston 60. The punch 40 is fixed to the punch plate 78 by the aid of a holder which surrounds a part of the outer circumferential surface. A guide sleeve 82, which is made of a cylindrical metal material, is externally fitted to the outer circumference of the holder 80. The second plate 42 is secured to the bottom surface of the holder 80.

It is preferable that the guide sleeve 82 is made of, for example, a metal material such as SKD 11, FC 25, or FC 30 based on JIS (Japan Industrial Standard), and the first ring member 34 is made of a material which is harder than that for the guide sleeve 82.

The holder 80 including the punch 40, the guide sleeve 82, the second plate 42, and other components function as a second die member. The punch 40 is provided displaceably in the vertical direction integrally with the elevator unit 54 in accordance with the guiding action of the plurality of guide means 12*a* to 12*d* provided in the upstanding manner on the first die holder 14.

As shown in FIG. 1, the hydraulic pressure control apparatus 10 according to the first embodiment is fixed via a seal member 100 to one of the joint blocks 66*b*. A hydraulic pressure source 102 is connected to the hydraulic pressure control apparatus 10 via a tube passage such as a tube.

Figure 3:
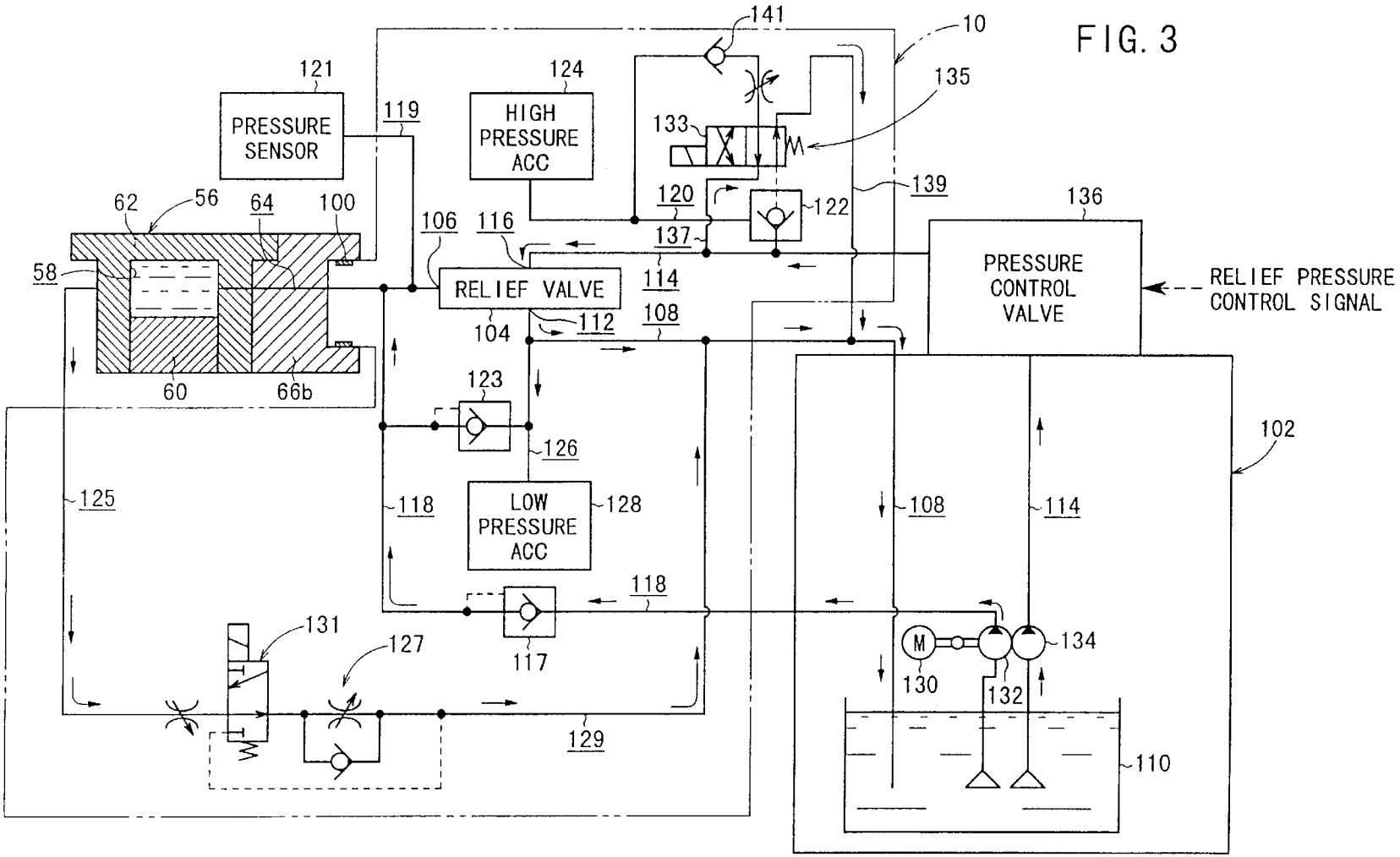
FIG. 3 shows a circuit system including the hydraulic pressure control apparatus.

As shown in FIG. 3, the hydraulic pressure control apparatus 10 includes a relief valve 104. The relief valve 104 has an inlet port 106 which communicates via the passage 64 with the pressure chamber 58 in which the piston 60 is accommodated, an outlet port 112 which communicates via a discharge passage 108 with a tank 110 of the hydraulic pressure source 102, and a relief port 116 which supplies the relief pressure to an unillustrated relief chamber via a relief pressure supply passage 114.

A supply passage 118, which is used to supply, to the pressure chamber 58, the pressure oil stored in the tank 110 of the oil pressure source 102 via a check valve 117 for the pilot operation, is connected to an intermediate position of the passage 64. A pressure sensor (pressure-detecting mechanism) 121, which is used to detect the hydraulic pressure of the pressure oil in the pressure chamber 58, is connected via a passage 119. The following arrangement is available In place of the pressure sensor 121. That Is, a pair of unillustrated pressure sensors are used. Detection signals, which are outputted from the pair of pressure sensors respectively, are introduced Into the unillustrated controller to execute the detection by obtaining AND on the basis of the pair of detection signals.

The relief valve 104 is constructed as follows. That is, when the hydraulic pressure of the pressure oil charged in the pressure chamber 58 exceeds the hydraulic pressure of the pressure oil charged in the relief chamber, and an unillustrated valve plug is displaced, then the valve-open state is given, in which the inlet port 106 communicates with the outlet port 112. On the other hand, when the hydraulic pressure of the pressure oil charged in the pressure chamber 58 is not more than the hydraulic pressure of the pressure oil charged in the relief chamber, the valve-closed state is given, in which the communication between the inlet port 106 and the outlet port 112 is blocked.

A high pressure accumulator (first accumulator) 124 is connected via a check valve 122 for the pilot operation is connected to a passage 120 which is branched from the relief pressure supply passage 114. A low pressure accumulator (second accumulator) 128 is connected to a passage 126 which is branched from the discharge passage 108. The low pressure accumulator 128 is connected to the supply passage 118 via a check valve 123 for the pilot operation. It is preferable to use a piston type having a large volume for the low pressure accumulator 128, and it is preferable to use a balloon type for the high pressure accumulator 124.

The check valve 122 is normally in the valve-open state, and it is in the valve-closed state in accordance with the action of pilot pressure supply to keep the internal pressure of the high pressure accumulator 124. Thus, the check valve 122 functions to protect the high pressure accumulator 124.

The pressure chamber 58 is connected via a passage 125 to the input side of an air vent circuit 127 for removing the air which contaminates the pressure oil charged in the pressure chamber 58. The output side of the air vent circuit 127 is connected via a passage 129 to the discharge passage 108.

The air vent circuit 127 includes an air vent valve 131 composed of a normally open type solenoid-operated valve. The air vent circuit 127 functions such that when the air vent valve 131 is in the valve-open state, the air contaminating the pressure oil is discharged via the discharge passage 108 to the tank 110 together with a small amount of pressure oil leaked from the pressure chamber 58. As a result, the air in the pressure oil charged in the pressure chamber 58 is removed.

The relief pressure supply passage 114 is provided with a relief pressure vent circuit 135 for making the relief preset pressure for the relief valve 104 to be zero by discharging the pressure oil stored in the relief chamber of the relief valve 104 to the discharge passage 108 in accordance with the changeover action of a relief pressure vent valve 133 composed of a solenoid-operated valve. A passage 137, which communicates with the relief pressure supply passage 114, is connected to the input side of the relief pressure vent valve 133. On the other hand, a passage 139, which communicates with the discharge passage 108, is connected to the output side of the relief pressure vent valve 133. Reference numeral 141 indicates a check valve.

In this embodiment, the relief valve 104, the relief pressure vent valve 133, and the unillustrated controller function as a pressure fluid control mechanism.

The hydraulic pressure source 102 includes the tank 110 in which the pressure oil is stored, a first hydraulic pump 132 for feeding the pressure oil via the supply passage 118 in accordance with the driving action of a motor 130, and a second hydraulic pump 134 for feeding the pressure oil to the relief chamber of the relief valve 104 via the relief pressure supply passage 114 in accordance with the driving action of the motor 130.

A pressure control valve 136, which controls the relief pressure of the relief valve 104 on the basis of a relief pressure control signal introduced from the unillustrated controller, is interposed between the second hydraulic pump 134 and the relief valve 104.

The forging die 11 incorporated with the hydraulic pressure control apparatus 10 according to the first embodiment of the present invention is basically constructed as described above. Next, explanation will be made for the forming steps for the forging material based on the use of the forging die 11. Explanation will be made below for an illustrative case in which an outer cup for constructing a constant velocity universal joint is forged and formed to obtain a forged product.

Figure 5:
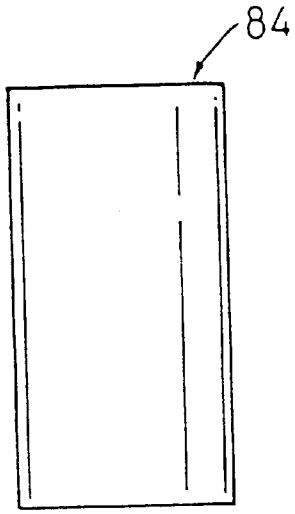
FIG. 5 illustrates a production step of an outer cup for constructing a constant velocity universal joint.
Figure 6:
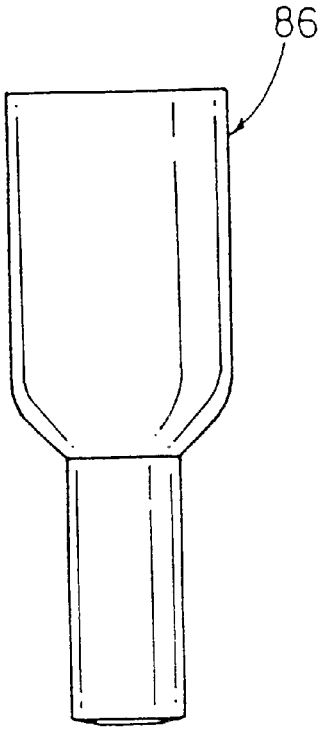
FIG. 6 illustrates a production step of the outer cup for constructing the constant velocity universal joint.
Figure 7:
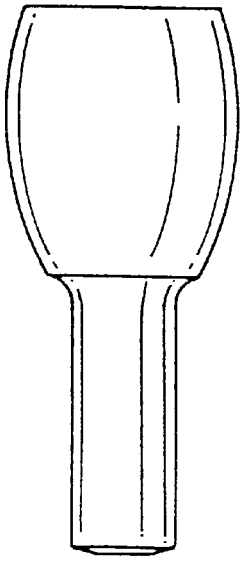
FIG. 7 illustrates a production step of the outer cup for constructing the constant velocity universal joint.

The primary forging process is applied to a columnar billet 84 as shown in FIG. 5 by using an unillustrated die apparatus to thereby obtain a primary forged product 86 having different diameters of those divided respectively by an intermediate step section as shown in FIG. 6. Subsequently, the preliminary forming process is applied to the primary forged product 86 (see FIG. 7), and then the secondary forging process is performed by using another unillustrated die apparatus. Thus, the secondary formed product 52, which is composed of a cup section 88 and a shaft section 90 as shown in FIG. 8, is obtained. The forging die 11 is used for the secondary formed product 52 as a forging material to which the tertiary forging process is further applied.

At first, the following preparatory operation is performed. That is, the upper die 26, the lower die 28, the sleeve 24, the forcible insertion ring 20, and the other components are assembled in an integrated manner in a state in which the guide sleeve 82 is inserted into the hole 32 of the first ring member 34. Thus, the punch 40 is positioned with respect to the cavity 46 which is formed by the upper die 26 and the lower die 28.

The pressure oil having a predetermined hydraulic pressure is previously charged in the pressure chamber 58 via the supply passage 118 and the passage 64 in accordance with the driving action of the first hydraulic pump 132. The pressure oil is supplied to the unillustrated relief chamber of the relief valve 104 via the relief pressure supply passage 114 in accordance with the driving action of the second hydraulic pump 134 so that a predetermined relief pressure is set. The relief preset pressure is controlled by the pressure control valve 136 on the basis of the relief pressure control signal introduced from the unillustrated controller.

If an unillustrated protective circuit (overload mechanism) is operated when any overload is generated, then a considerable period of time is required to restore the ordinary operation state, and it is impossible to continuously perform the forging process. Therefore, the hydraulic pressure support load of the piston 60 is set to be not less than the forming load on the forging material and not more than the overload operation load. In this arrangement, the forming load on the forging material is supported by the pressure oil charged in the pressure chamber 58.

Subsequently, the secondary formed product 52 as the forging material is charged into the cavity 46 in a state in which the punch 40 is arranged at an unillustrated raised position (initial position). The punch 40 is lowered integrally with the elevator unit 54 which is joined to the ram in accordance with the driving action of the unillustrated mechanical press to give the state shown in FIG. 1. Thus, the forging process is started.

When the punch 40 is lowered integrally with the elevator unit 54, any unbalanced load in the transverse direction is preferably absorbed by the plurality of guide means 12*a* to 12*d* which are provided between the elevator unit 54 and the first die holder 14. Accordingly, the punch 40 can be smoothly inserted under the pressure into the center of the hole 32 of the first and second ring members 34, 36 arranged coaxially with the cavity 46 by the aid of the guide sleeve 82.

When the forging process is started, the guide sleeve 82, which is externally fitted to the part of the outer circumferential surface of the punch 40, advances in accordance with the guiding action of an unillustrated annular groove formed at the upper end of the hole 32 of the first ring member 34, and the punch 40 is further lowered. Accordingly, the punch 40, the holder 80, and the guide sleeve 82 are displaced in an integrated manner in a state of being forcibly inserted into the hole 32 of the first ring member 34.

Figure 9:
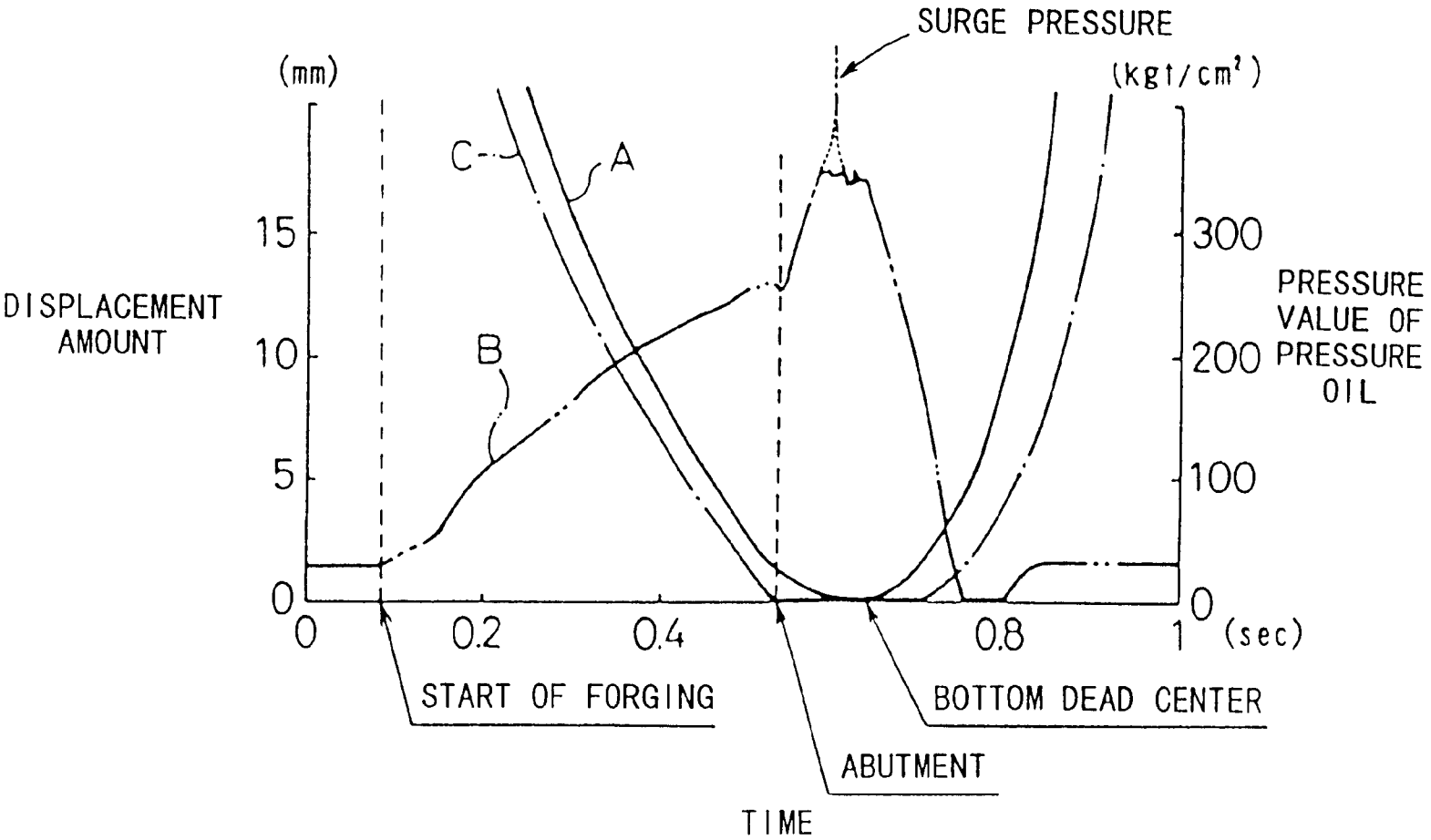
FIG. 9 illustrates the relationship between the displacement amount of the punch and the pressure value of the pressure oil.

FIG. 9 shows the relationship between the displacement amount of the punch 40 and the pressure oil charged in the pressure chamber 58. In FIG. 9, a curved line A depicted by a solid line indicates the displacement amount of the punch 40 which is displaced integrally with the ram in accordance with the driving action of the unillustrated mechanical press. A curved line B depicted by a two-dot chain line indicates the pressure value (hydraulic pressure) of the pressure oil charged in the pressure chamber 58. A curved line C depicted by a dashed line indicates the spacing distance D (see FIG. 1) between the second plate 42 disposed on the displacement side and the first plate 44 disposed on the fixed side.

The ram of the unillustrated mechanical press is displaced downwardly from the predetermined raised position, and the punch 40, the second plate 42, and the other components are lowered integrally with the ram. Accordingly, the spacing distance D between the first plate 44 on the fixed side and the second plate 42 on the displacement side is gradually decreased. The piston 60 is prevented from displacement in the downward direction by being held by the stopper 68. The hydraulic pressure of the pressure oil charged in the pressure chamber 58 is gradually increased in accordance with the increase in load applied to the punch 40 after the start of the forging process.

The second plate 42 abuts against the first plate 44 immediately before the arrival at the bottom dead center as a result of the further downward movement of the punch 40 from the state shown in FIG. 1. That is, the spacing distance D between the first plate 44 and the second plate 42 is zero. Accordingly, the downward displacement of the punch 40 is regulated, and the thickness for the forging material is correctly regulated. Thus, the forging process is completed.

The punch 40 is further lowered by a minute distance, and the hydraulic pressure in the pressure chamber 58 arrives at the relief preset pressure. Accordingly, the relief valve 104 is in the valve-open state. The pressure oil in the pressure chamber 58 is discharged to the outside to arrive at the state shown in FIG. 2 in accordance with the stroking action of the piston 60.

When the pressure oil in the pressure chamber 58 is relieved, if the outflow resistance of the pressure oil is high, then it is feared that the so-called surge pressure is generated (see a broken line in FIG. 9), in which the hydraulic pressure is instantaneously increased to be not less than the relief preset pressure. In order to avoid the occurrence of the surge pressure, it is necessary that the valve plug of the relief valve 104 is quickly opened immediately after the hydraulic pressure in the pressure chamber 58 arrives at the relief preset pressure so that the outflowing pressure oil is rapidly discharged to the outside.

For this purpose, in the first embodiment, the pressure oil, which is supplied to the relief chamber of the relief valve 104, is sucked into the high pressure accumulator 124 in accordance with the driving action of the high pressure accumulator immediately after the hydraulic pressure in the pressure chamber 58 arrives at the relief preset pressure. Therefore, the relief preset pressure is suddenly decreased, and hence the valve plug is instantaneously switched from the valve-closed state to the valve-open state.

Further, the relief valve 104 is in the valve-open state, and the inlet port 106 communicates with the outlet port 112.

Accordingly, the passage 64 communicates with the discharge passage 108. The large volume of the pressure oil, which is charged in the pressure chamber 58, is discharged at a high discharge speed toward the tank 110 of the hydraulic pressure source 102 via the passage 64 and the discharge passage 108 which make communication with each other. During this process, the large volume of the pressure oil, which is charged in the pressure chamber 58, is sucked into the low pressure accumulator 128 in accordance with the driving action of the low pressure accumulator 128. Therefore, it is possible to reduce the flow passage resistance when the large volume of the pressure oil charged in the pressure chamber 58 outflows along the discharge passage 108, and it is possible to avoid the occurrence of the surge pressure.

Although the pressure oil, which has passed through the relief valve 104, is discharged at a high speed, it is substantially at the ordinary pressure. Therefore, it is enough not to use the high pressure accumulator but to use the low pressure accumulator having the large volume. The pressure oil, which is temporarily stored in the high pressure accumulator 124, passes through the check valve 122 and the relief pressure supply passage 114, and it is supplied to the unillustrated relief chamber of the relief valve 104. On the other hand, the pressure oil, which is temporarily stored in the low pressure accumulator 128, passes through the check valve 123 and the supply passage 118, and it is supplied to the pressure chamber 58.

As described above, in the first embodiment, the valve-closed state and the valve-open state of the relief valve 104 are instantaneously switched in accordance with the driving action of the high pressure accumulator 124. The large volume of the pressure oil, which is charged in the pressure chamber 58, is temporarily stored in accordance with the driving action of the low pressure accumulator 128. Thus, the pressure oil, which is applied with the high pressure and which has the high discharge speed, is discharged into the tank 110 without generating the surge pressure. As a result, the forming load, which is applied to the forging material during the forging process, is preferably supported by the pressure oil charged in the pressure chamber 58. Thus, it is possible to smoothly effect the buffering function.

In the first embodiment, the variation amount, which is caused by the elongation of, for example, the frame of the unillustrated mechanical press and the connecting rod and which would otherwise cause the fluctuation of the thickness dimension of the forging material in ordinary cases, is absorbed as the change in stroke amount of the piston 60. Further, the thickness dimension of the material is determined by the abutment of the upper and lower dies. Therefore, no influence is exerted thereon by the elongation of, for example, the frame and the connecting rod.

Figure 10:
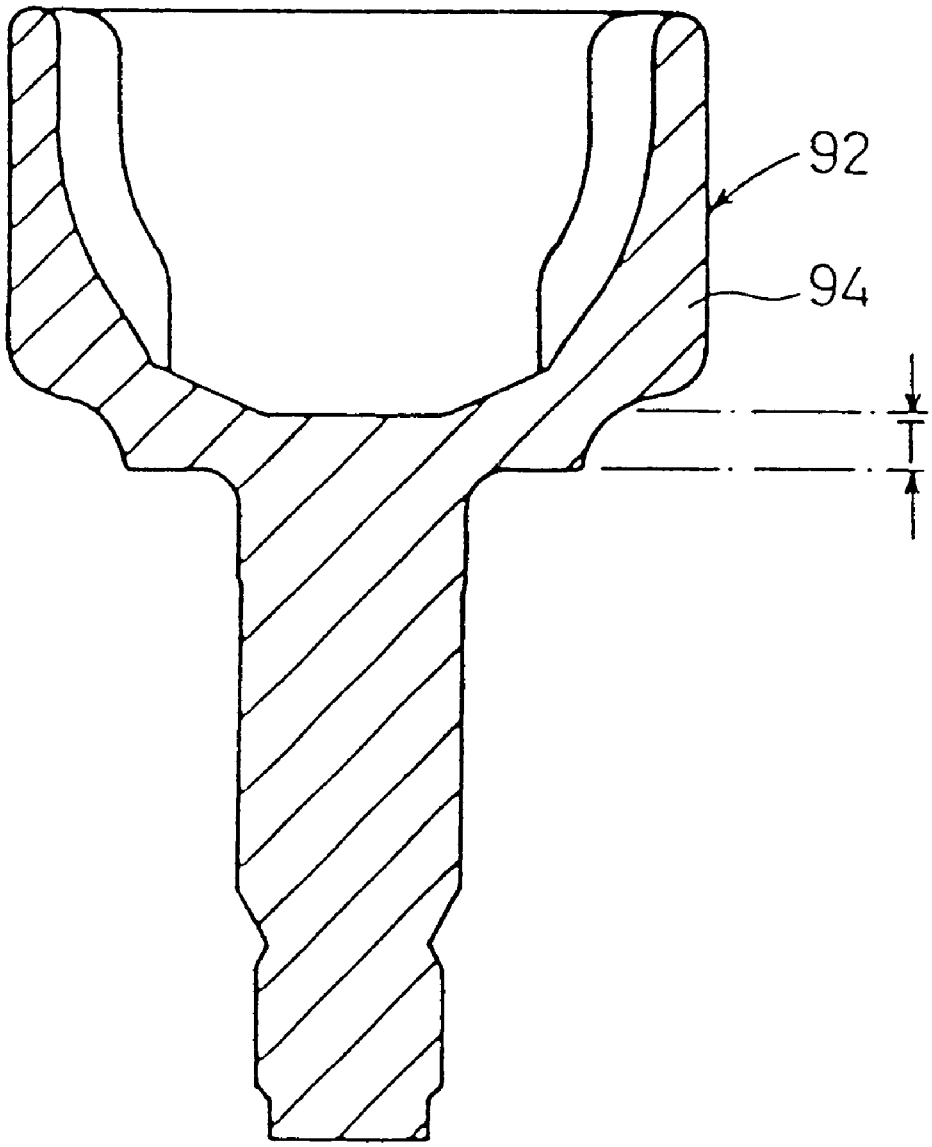
FIG. 10 illustrates the dimension of the bottom thickness of the cup of the outer cup obtained as a forged product.

As described above, the dimension of the bottom thickness T (see FIG. 10) of the cup section 94 of the outer cup obtained as the forged product 92 is determined by the abutment between the second plate 42 which is disposed on the side of the punch 40 and the first plate 44 which is disposed on the side of the forcible insertion ring 20. Therefore, no dispersion occurs in the dimension of the bottom thickness T of the cup section 94 of the outer cup obtained as the forged product 92. The dimensional accuracy of the bottom thickness T of the cup section 94 is maintained highly accurately.

Figure 2:
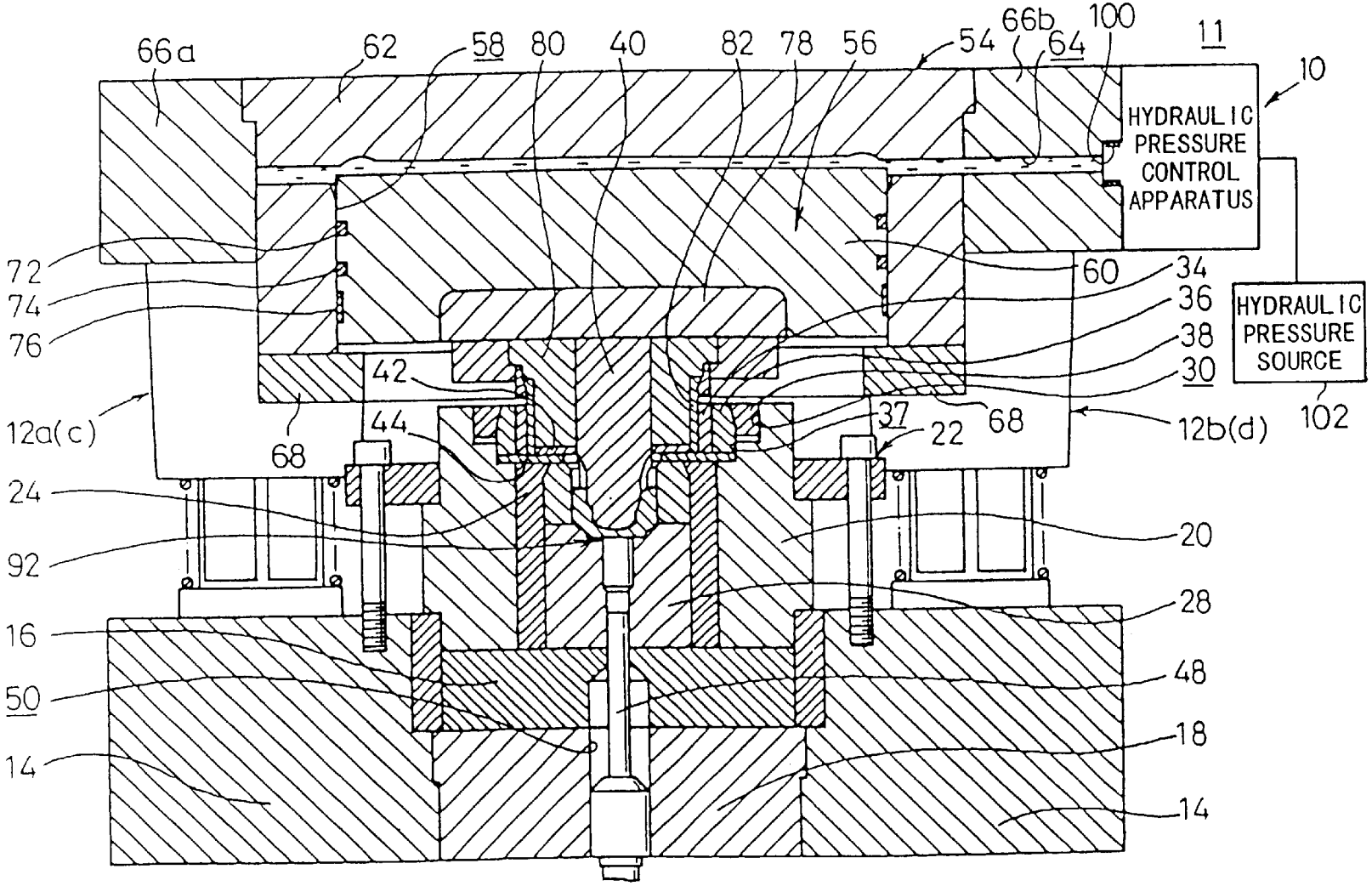
FIG. 2 illustrates the operation depicting a state in which the forging process is completed after a punch is lowered from a forging start position shown in FIG. 1.

The punch 40 is lowered as described above, and it arrives at the forging end position shown in FIG. 2 from the forging start position shown in FIG. 1. Thus, the forging is applied to the forging material by the aid of the punch 40, the lower die 28, and the upper die 26. The forging material causes plastic flow along with the shape of the cavity 46.

After completion of the forging process, the punch 40 is raised to the initial position integrally with the elevator unit 54 connected to the ram in accordance with the driving action of the mechanical press. Accordingly, the punch 40, the holder 80, and the guide sleeve 82 are separated from the hole 32 of the first ring member 34, giving a waiting state for the next step. The forged product 92 (see FIG. 10) is taken out in accordance with the displacement action of the knockout pin 48.

Next, explanation will be made with reference to a flow chart shown in FIG. 11 for the function and effect of the hydraulic pressure control apparatus 10 including, for example, the air vent circuit 127 and the relief pressure vent circuit 135.

It is assumed that the pressure oil having a predetermined hydraulic pressure is previously charged in the pressure chamber 58 via the supply passage 118 and the passage 64 in accordance with the driving action of the first hydraulic pump 132 (step S1).

The air vent valve 131 of the air vent circuit 127 is deenergized to previously give the valve-open state. Therefore, the air, which contaminates the pressure oil charged in the pressure chamber 58, is discharged to the tank 110 via the passage 129 and the discharge passage 108 together with a small amount of pressure oil leaked from the pressure chamber 58. As a result, the air in the pressure oil charged in the pressure chamber 58 is reliably removed.

After completion of the preparatory operation as described above, the unillustrated controller energizes the solenoid-operated valve so that the air vent valve 131 is in the valve-closed state (step S2).

Figure 12:
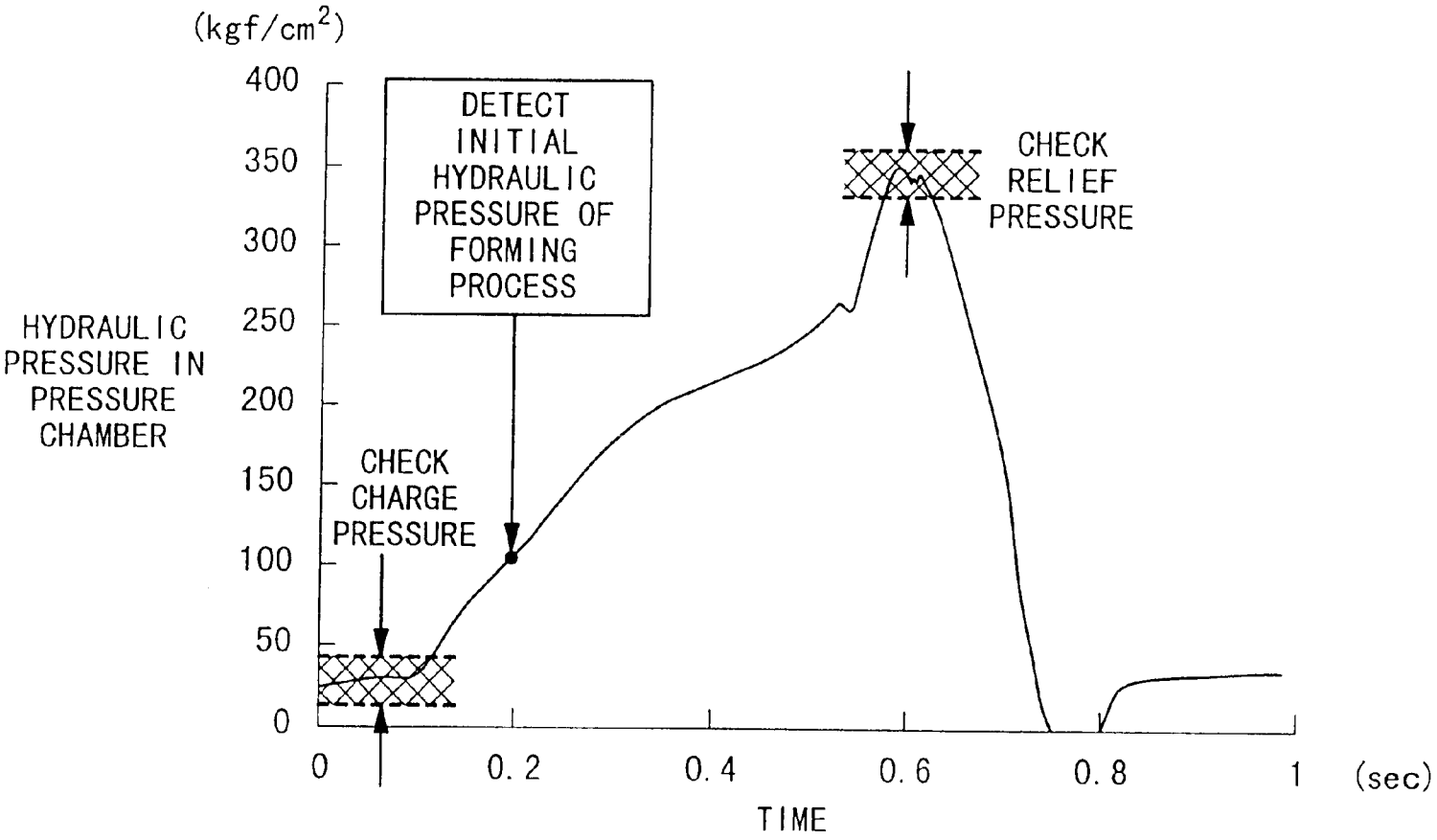
FIG. 12 illustrates the relationship between the time and the hydraulic pressure of the pressure oil charged in a pressure chamber.

In the valve-closed state of the air vent valve 131, the pressure sensor 121 detects the charge pressure of the pressure oil charged in the pressure chamber 58 (see FIG. 12), and an obtained detection signal is sent to the unillustrated controller. The controller judges whether or not the charge pressure of the pressure oil in the pressure chamber 58 is not less than the preset pressure on the basis of the detection signal (step S3). If the charge pressure is less than the preset pressure, a driving stop signal is sent to the unillustrated mechanical press. As a result, the operation of the mechanical press is immediately stopped. Accordingly, the punch 40 is held in the state of being stopped at the top dead center (step S4). If the charge pressure of the pressure oil in the pressure chamber 58 is not less than the preset pressure, the routine proceeds to the next step S5.

In the step S5, the punch 40 is lowered in accordance with the driving action to the mechanical press, and the forming process is started for the forging material. Accordingly, the hydraulic pressure of the pressure oil in the pressure chamber 58 is increased. In this embodiment, the pressure sensor 121 detects the hydraulic pressure of the pressure oil in the pressure chamber 58 at the initial stage of the forming process (see FIG. 12). An obtained detection signal is sent to the unillustrated controller. The controller judges from the detection signal whether or not the hydraulic pressure of the pressure oil in the pressure chamber 58 at the initial stage of the forming process is increased up to the initial preset pressure (step S6). If the hydraulic pressure of the pressure oil in the pressure chamber 58 is not increased to the initial preset pressure, then it is judged that the forging material is not charged in the cavity 46, and an energizing signal is sent to the relief pressure vent valve 133 so that the relief pressure vent valve 133 is in the ON state. Accordingly, the relief control pressure for the relief valve 104 is subjected to the open state (step S7).

That is, the valve position of the relief pressure vent valve 133 is switched. The pressure oil, which is stored in the relief chamber of the relief valve 104, passes through the passage 137, the relief pressure vent valve 133, and the passage 139, and it is discharged to the tank 110 via the discharge passage 108. Therefore, the relief control pressure is quickly reduced to be zero, and the relief valve 104 is in the valve-open state. When the valve position of the relief pressure vent valve 133 is switched, the pilot pressure is supplied to the check valve 122. The check valve 122 is in the valve-closed state, and the internal pressure of the high pressure accumulator is maintained at the predetermined pressure.

When the relief valve 104 is in the valve-open state, the inlet port 106 communicates with the outlet port 112. The large volume of the pressure oil charged in the pressure chamber 58 is sucked into the low pressure accumulator 128 in accordance with the driving action of the low pressure accumulator 128. As a result, the flow passage resistance is reduced when the pressure oil having the large volume charged in the pressure chamber 58 is discharged along the discharge passage 108. Thus, it is possible to avoid the occurrence of the surge pressure (see FIG. 9).

In this case, there is given the state in which no forging material is charged. The pressure oil support load of the piston 60 acts on the abutment portion between the first plate 44 and the second plate 42. However, the relief valve 104 is in the valve-open state, and the relief pressure of the relief valve 104 becomes zero. Accordingly, the pressure oil support load, which is applied to the abutment portion between the first plate 44 and the second plate 42, is zero. Thus, neither shock nor damage is applied to the upper die and the lower die at all. In this process, the unillustrated controller judges that the charge of the forging material is abnormal. The punch 40 is raised in accordance with the driving action of the mechanical press, and it is stopped upon arrival at the top dead center (step S8).

Subsequently, if the hydraulic pressure of the pressure oil in the pressure chamber 58 is increased to the initial preset hydraulic pressure at the initial stage, the load sensor 45 is used to detect whether or not the predetermined forming load is applied to the forging material by the punch 40 (step S9).

That is, the load sensor 45 is used to detect the fact that the first plate 44 and the second plate 42 make certain abutment. The load sensor 45 sends a detection signal to the unillustrated controller. The controller judges on the basis of the detection signal whether or not the first plate 44 and the second plate 42 make abutment at not less than the predetermined load, and the forging material is forged to have the predetermined thickness dimension.

Figure 13:
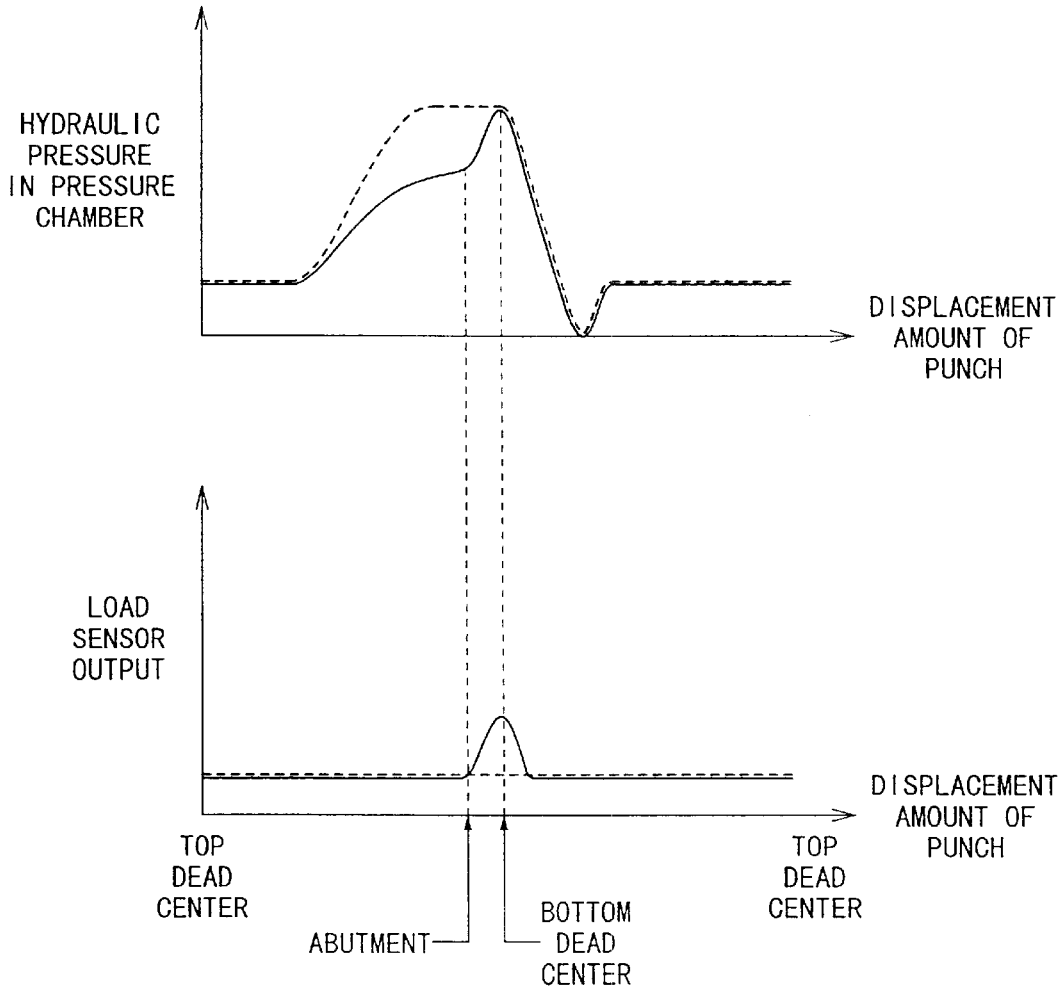
FIG. 13 illustrates the output of a load sensor corresponding to the change in hydraulic pressure in the pressure chamber concerning a case in which a first plate and a second plate make abutment and a case in which the first plate and the second plate make no abutment.

For example, as shown by a solid line in FIG. 13, when the output of the load sensor 45 changes along a hill-shaped curve corresponding to the change in hydraulic pressure of the pressure oil in the pressure chamber 58, the controller Judges that the first plate 44 and the second plate 42 make abutment at not less than the predetermined load, and the thickness dimension of the forging material is regulated to be the predetermined thickness dimension in accordance with the abutment of the dies.

On the contrary, when the forming load on the forging material is higher than the pressure oil support load, and the output of the load sensor 45 corresponding to the change in hydraulic pressure of the pressure oil in the pressure chamber 58 is linearly flat as shown by a broken line in FIG. 13, then the controller judges that the pressure oil is relieved without making the abutment between the first plate 44 and the second plate 42, and the thickness dimension of the forging material is not regulated by the abutment of the dies.

The thickness dimension for the forging material can be made more accurate such that the unillustrated controller feedback-controls the relief pressure on the basis of the detection signal outputted from the load sensor 45. That is, the controller sends, to the pressure control valve 136, the relief pressure control signal corresponding to the detection signal outputted from the load sensor 45 to control the relief pressure corresponding to the abutment load. Thus, the thickness of the forging material can be regulated highly accurately.

If the abutment of the dies is not detected from the detection signal outputted from the load sensor 45, then the controller judges that the abutment of the dies is abnormal, and it outputs the driving stop signal to the unillustrated mechanical press. Accordingly, the punch 40 is raised, and then it is stopped at the top dead center (step S10). If the predetermined forming load is applied, the routine proceeds to the next step S11.

Subsequently, the forming load is applied to the forging material by the punch 40. Before the punch 40 arrives at the bottom dead center, the pressure sensor 121 detects the relief preset pressure in the pressure chamber 58 (see FIG. 12), and a detection signal is sent to the unillustrated controller. The unillustrated controller judges whether or not the relief preset pressure is within the predetermined range on the basis of the detection signal (step S11).

If the relief preset pressure is not within the predetermined range, the driving stop signal is outputted to the unillustrated mechanical press. Accordingly, the punch 40 is raised, and then it is stopped at the top dead center (step S12). If it is judged that the relief preset pressure is within the predetermined range, the routine proceeds to the next step S13.

In the next step S13, the pressure oil in the pressure chamber 58 is relieved in accordance with the displacement action of the piston 60. The punch 40 arrives at the bottom dead center, and then it is raised toward the top dead center. The following operation is performed during the period in which the punch 40 arrives at the bottom dead center, it is then raised, and it arrives at the top dead center. That is, the pressure oil is charged again in the pressure chamber 58 via the supply passage 118. The piston 60 is restored to the initial position. Further, the unillustrated controller is used to deenergize the solenoid-operated valve so that the air vent valve 131 is in the valve-open state (steps S14 to S17).

When the steps as described above are continuously performed, the forging process can be continuously applied to the forging material.

In the first embodiment, it is detected that the forging material is not charged in the cavity 46 at the stage of the initial increase of the hydraulic pressure. The valve position of the relief pressure vent valve 133 is switched so that the pressure oil support load is made zero. Accordingly, the dies are prevented from application of overload upon the abutment between the first plate 44 and the second plate 42. As a result, according to this embodiment, the occurrence of stress in the die is avoided, the die is prevented from breakage, and it is possible to improve the durability of the die.

In the first embodiment, the variation amount, which is caused by the elongation of, for example, the frame of the unillustrated mechanical press and the connecting rod and which would otherwise cause the fluctuation of the thickness dimension of the forging material in ordinary cases, is absorbed as the change in stroke amount of the piston 60. Further, the thickness dimension of the material is determined by the abutment of the upper die and the lower die. Therefore, no influence is exerted by the elongation of the frame or the like.

In the first embodiment, the outer cup for constructing the constant velocity universal joint is used as the forging material. However, there is no limitation thereto. It is a matter of course that the present invention is applicable to a variety of forged products which require the dimensional accuracy in the thickness direction of the part including, for example, stepped parts and stepped gears which are not shown in the drawings.

Additionally, in the first embodiment, the buffering mechanism 56 is provided on the elevator unit 54 disposed on the displacement side. However, there is no limitation thereto. The buffering mechanism 56 may be provided on the fixed side, for example, on the upper die 26 and the lower die 28.

Figure 14:
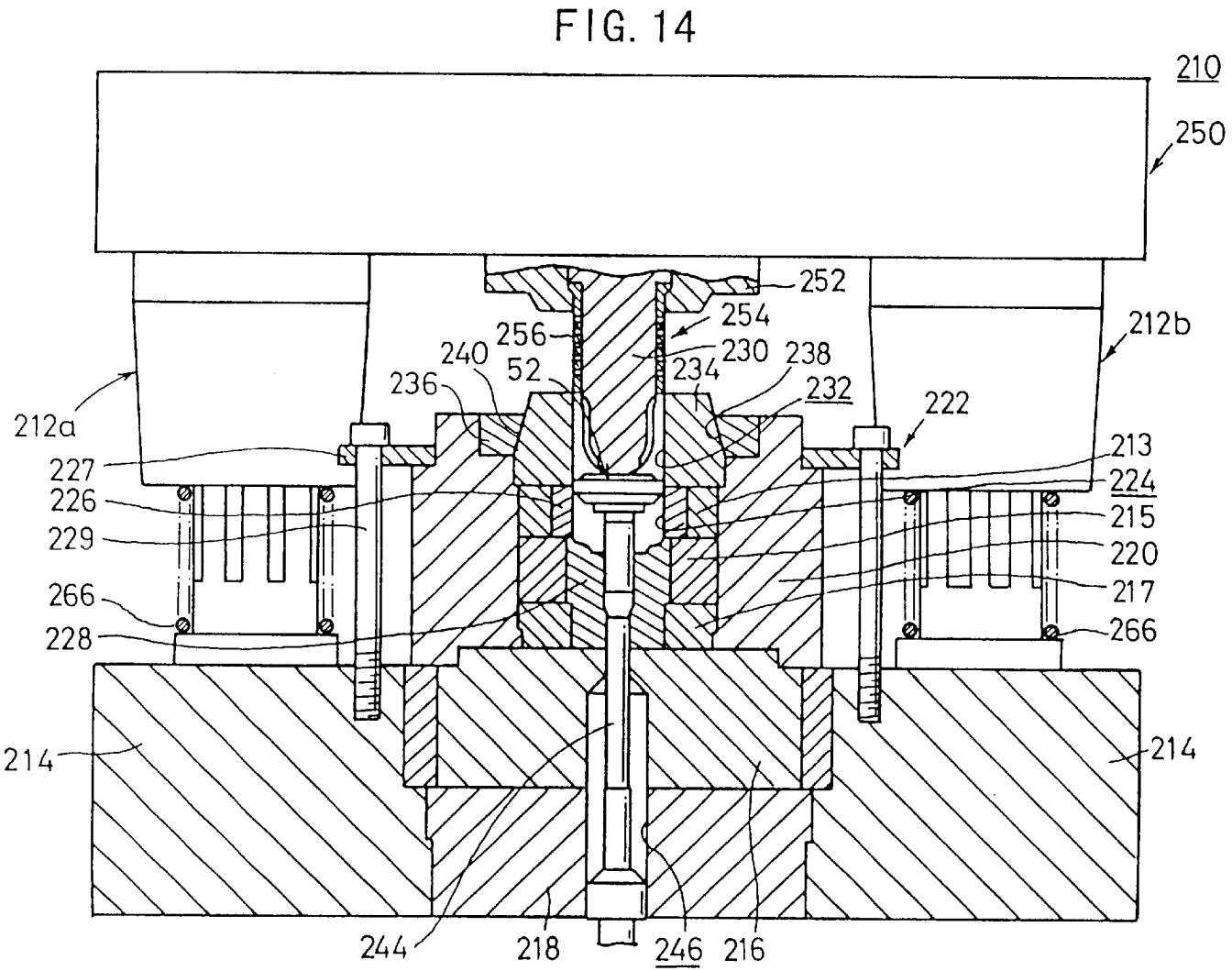
FIG. 14 shows a longitudinal sectional view illustrating a forging die according to a second embodiment of the present invention.

Next, a forging die 210 according to a second embodiment of the present invention is shown in FIG. 14. In the following embodiments, the same constitutive components are designated by the same reference numerals, detailed explanation of which will be omitted.

Figure 17:
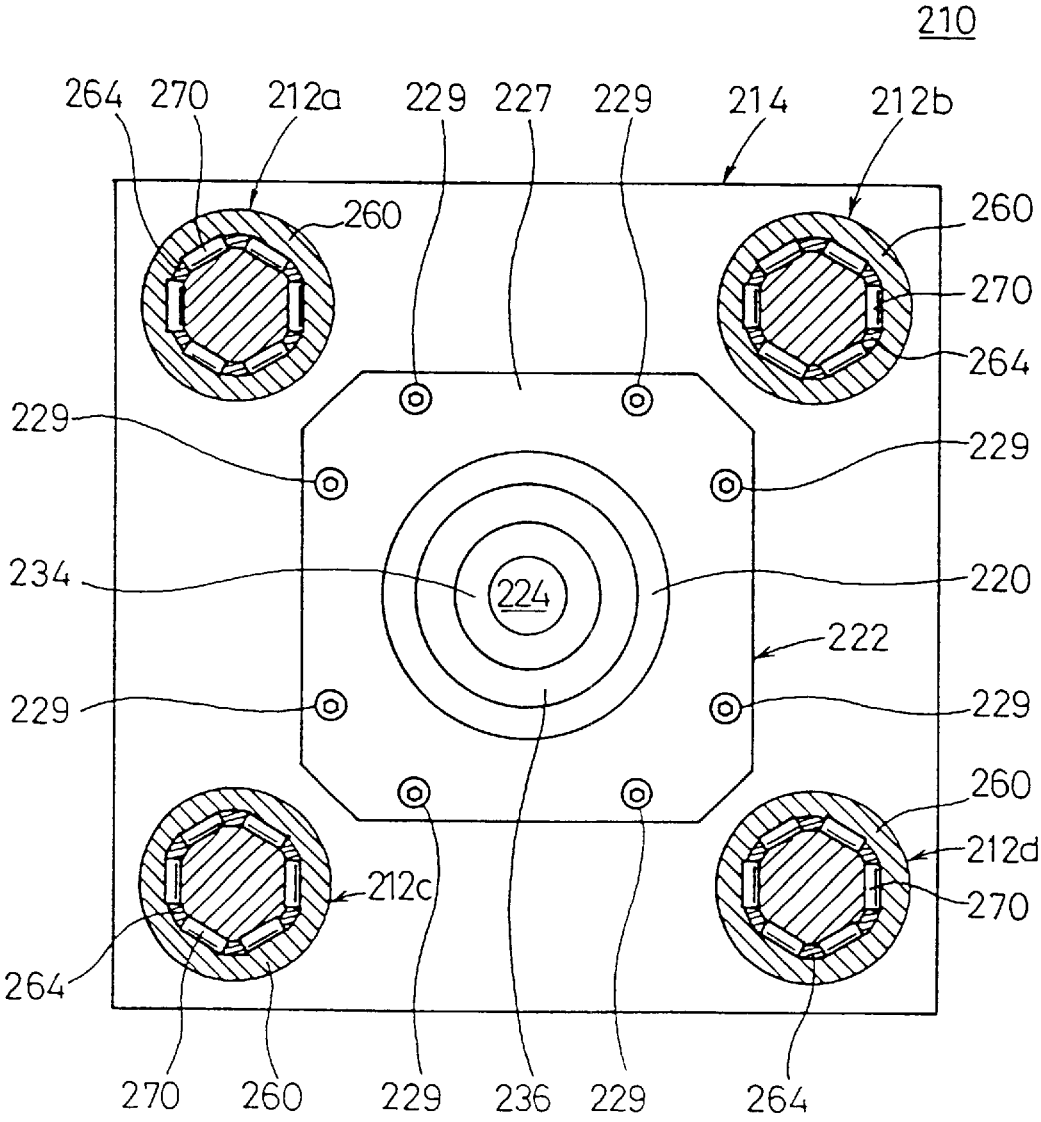
FIG. 17 shows a plan view with partial cross section illustrating the forging die shown in FIG. 14.

The forging die 210 comprises a first die holder 214 which is provided with a plurality of guide means 212*a* to 212*d* (see FIG. 17) standing thereon in the vicinity of four corners, and a second die holder 216 and a third die holder 218 which are provided in a stacked manner at a central portion of the first die holder 214. A thick-walled forcible insertion ring (cylindrical member) 220 is fixed on the second die holder 216 by the aid of a clamping means 222.

Figure 16:
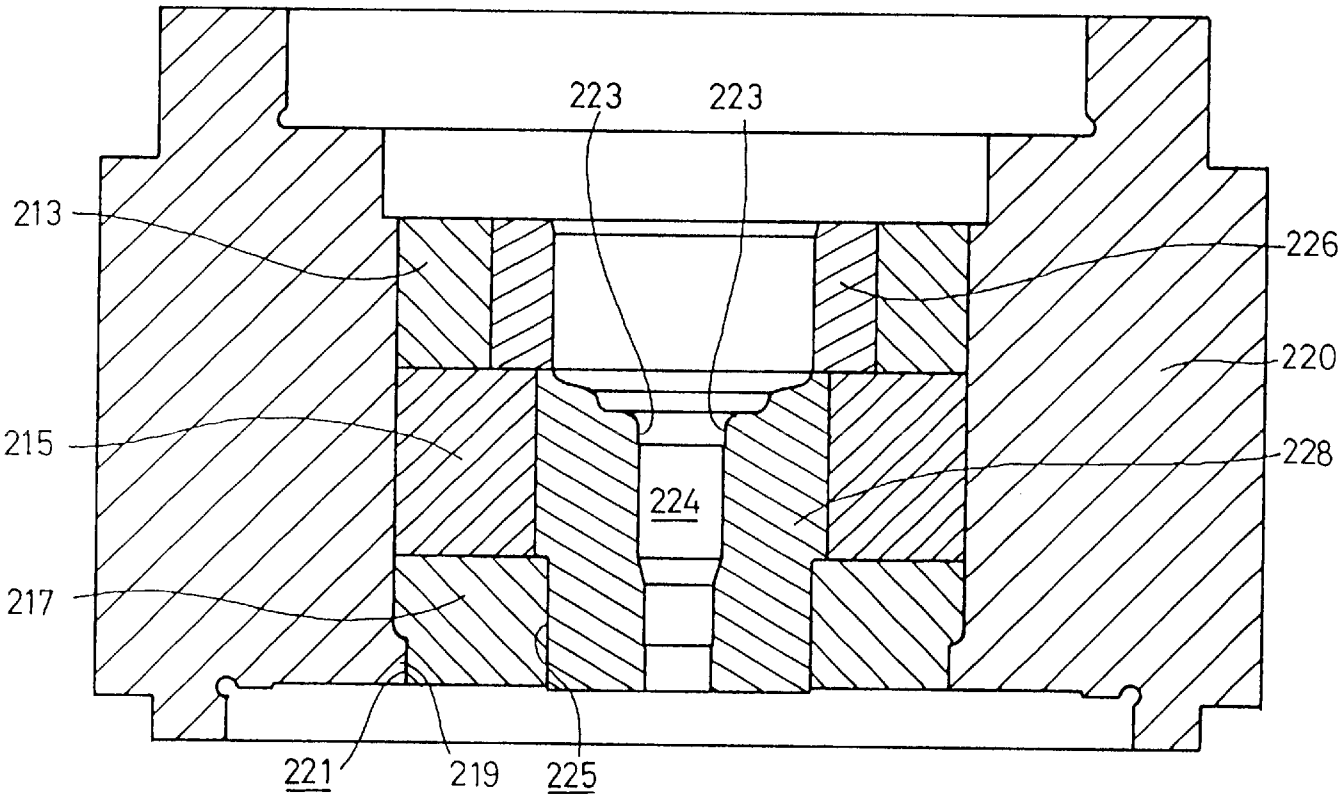
FIG. 16 shows a partial magnified longitudinal sectional view illustrating the forging die shown in FIG. 14.

As shown in FIG. 16, a first insert member 213, a second insert member 215, and a third insert member 217, which are formed as ring members in a divided manner, are joined in an integrated manner along the axial direction in the hole of the forcible insertion ring 220. In this embodiment, the outer diameter of each of the first to third insert members 213, 215, 217 is designed to be slightly larger than the inner diameter of the hole of the forcible insertion ring 220. The first to third insert members 213, 215, 217 are fitted into the hole of the forcible insertion ring 220 by means of shrinkage fitting as described later on. The first to third insert members 213, 215, 217 function as a plurality of annular members.

The first insert member 213 and the third insert member 217 are made of, for example, a metal material of SKD 61 (based on JIS) having a Rockwell hardness HRC of about 50. The second insert member 215 is made of, for example, a cemented carbide material having a Rockwell hardness HRA of about 88. Therefore, the second insert member 215 is designed to have a larger hardness as compared with the first insert member 213 and the third insert member 217.

As shown in FIG. 16, an annular projection 219 is formed at a lower portion of the inner circumferential surface of the forcible insertion ring 220. The annular projection 219 is fitted to an annular recess 221 which is formed on the third insert member 217. Thus, the downward displacement of the third insert member 217 is regulated, and it is positioned in the hole of the forcible insertion ring 220.

As shown in FIGS. 14 and 16, the clamping means 222 includes a fixing plate 227 for engaging with a step section of the forcible insertion ring 220, and a plurality of bolts 229 for holding the fixing plate 227 on the first die holder 214.

An upper die 226 and a lower die 228, which are formed in a divided manner, are joined in an integrated manner along the axial direction at the inside of the first to third insert members 213, 215, 217. A cavity 224 for charging a forging material therein is formed at the inside of the upper die 226 and the lower die 228. The upper die 226 and the lower die 228 function as a die member.

Figure 21:
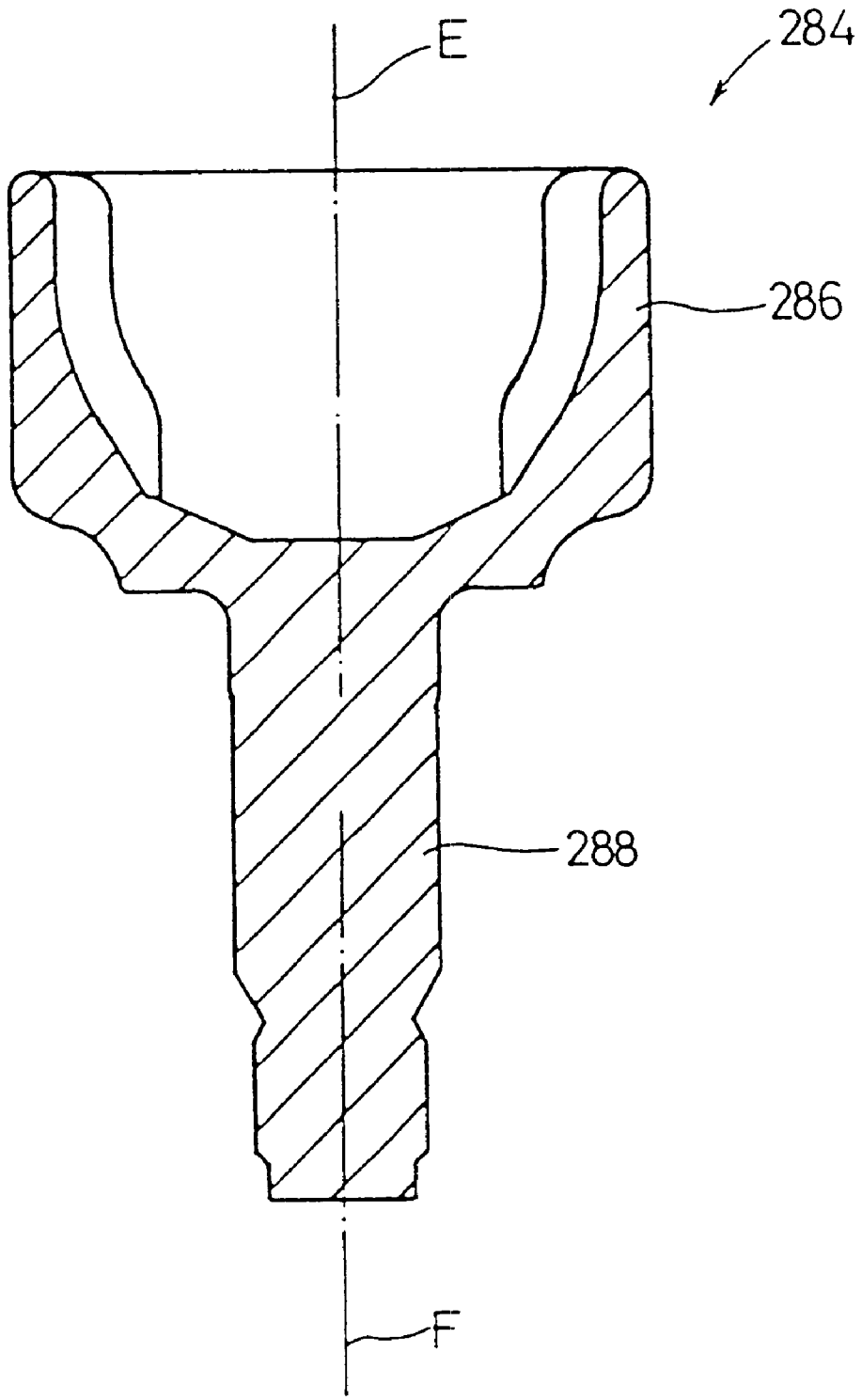
FIG. 21 shows a longitudinal sectional view taken along the axial direction illustrating a forged product forged by using the forging die shown in FIG. 14.

In this embodiment, the stress is concentrated on an inner wall surface 223 of the lower die 228 when the forging process is performed, corresponding to a joint portion of a cup section 286 and a shaft section 288 of an outer cup as a forged product 284 (see FIG. 21). The lower die 228, which has the inner wall surface 223 as described above, is externally fitted by the annular second insert member 215 which is composed of the harder material. Therefore, the rigidity is enhanced in the circumferential direction approximately perpendicular to the axis. An annular recess 225, which is engaged with the third insert member 217, is formed on the lower side of the outer circumferential surface of the lower die 228.

As shown in FIG. 14, a first ring member (ring member) 234, which is formed with a hole 232 for forcibly inserting a punch 230 thereinto, is integrally joined to the upper surfaces of the upper die 226 and the first insert member 213. A second ring member 236 having a large diameter, which is externally fitted to the first ring member 234, is integrally joined onto the upper surface of the forcible insertion ring 220.

In this embodiment, the second ring member 236 is fastened to the forcible insertion ring 220 so that the first ring member 234 is externally fitted thereby. Accordingly, a tapered surface 238, which is formed on the second ring member 236, slidably contacts with an inverse tapered surface 240 which is formed on the first ring member 234. Thus, the force acts to press the first ring member 234 downwardly.

An annular guide groove (not shown), which is used to guide the punch 230 when the punch 230 is forcibly inserted, is formed at an upper portion of the hole 232 of the first ring member 234. The punch 230, which is forcibly inserted into the hole 232 of the first ring member 234, has its one end which is formed with a desired convex-concave configuration corresponding to a concave-convex configuration of the product to be forged.

A knockout pin 244 for extruding the forged product is arranged movably back and forth along a hole 246 formed through the second die holder 216 and the third die holder 218, under the cavity 224 which is formed by the upper die 226 and the lower die 228. The secondary formed product 52 as shown in FIG. 8 is charged as the forging material in the cavity 224.

An elevator unit 250, which is connected to a ram of an unillustrated mechanical press and which is displaceable in the vertical direction integrally with the ram in accordance with the driving action of the mechanical press, is provided over the forcible insertion ring 220 at a position separated by a predetermined distance. The punch 230 is fixed to the elevator unit 250 by the aid of a jig 252. A cylindrical guide sleeve (sleeve member) 254, which is formed of a metal material, is externally fitted to a predetermined portion of the outer circumference of the punch 230.

Figure 20:
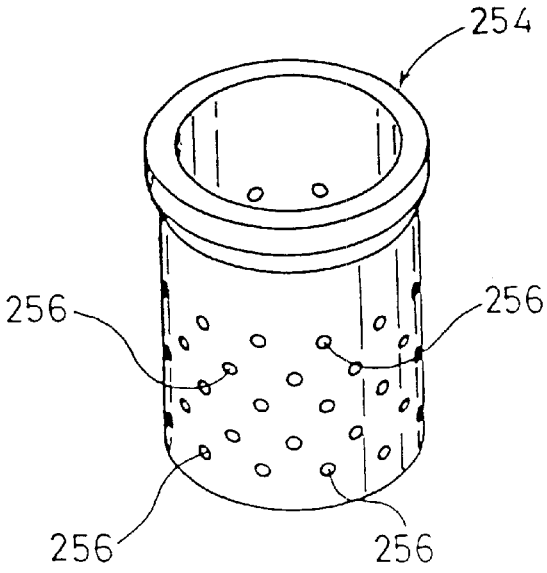
FIG. 20 shows a perspective view illustrating a guide sleeve to be externally fitted to the punch.

As shown in FIG. 20, graphite 256 is embedded in a plurality of holes of the guide sleeve 254. Accordingly, it is possible to well maintain the lubrication characteristic when the guide sleeve 254 is forcibly inserted into the hole 232 of the first ring member 234. In this embodiment, the diameter on the outer circumferential side of the guide sleeve 254 externally fitted to the punch 230 is designed to be slightly larger than the diameter on the inner circumferential side of the hole 232 of the first ring member 234.

It is preferable that the guide sleeve 254 is made of, for example, a metal material such as SKD 11, FC 25, or FC 30 based on JIS, and the first ring member 234 is made of a material which is harder than that for the guide sleeve 254.

The punch 230 is displaceable in the vertical direction integrally with the elevator unit 250 in accordance with the guiding action of the plurality of guide means 212*a* to 212*d* provided in the upstanding manner on the first die holder 214.

Figure 18:
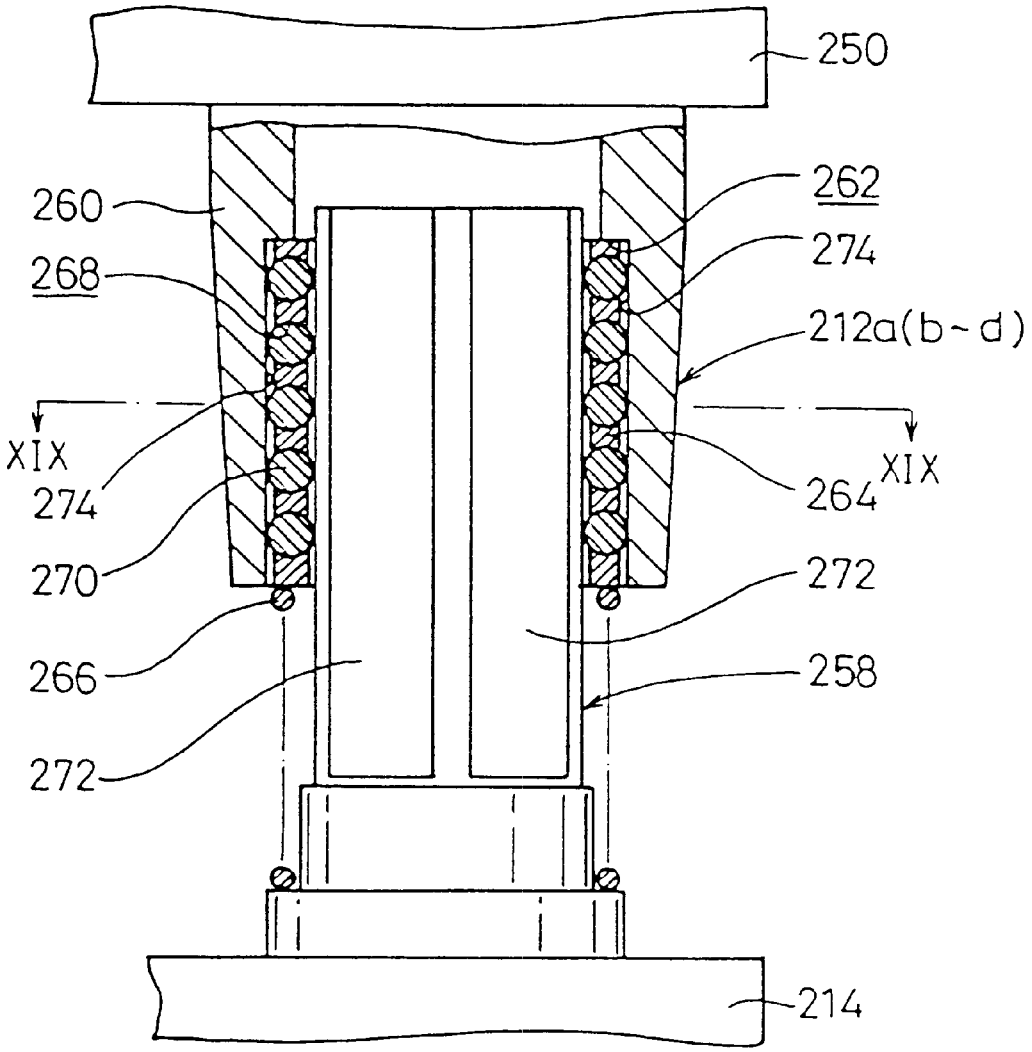
FIG. 18 shows a longitudinal sectional view taken along the axial direction illustrating a guide means provided for the forging die shown in FIG. 14.

As shown in FIG. 18, the guide means 212*a* (212*b* to 212*d*) comprises a lengthy main post body 258 which is fixed to the first die holder 214, a cylindrical cover member 260 which is connected to the elevator unit 250 and which is displaceable integrally with the elevator unit 250, a guide ring 264 which is provided to surround the outer circumference of the main post body 258 and which is slidably displaceable along the axial direction of the main post body 258 by making engagement with an annular step section 262 of the cover member 260, and a spring member 266 for supporting the guide ring 264.

Figure 19:
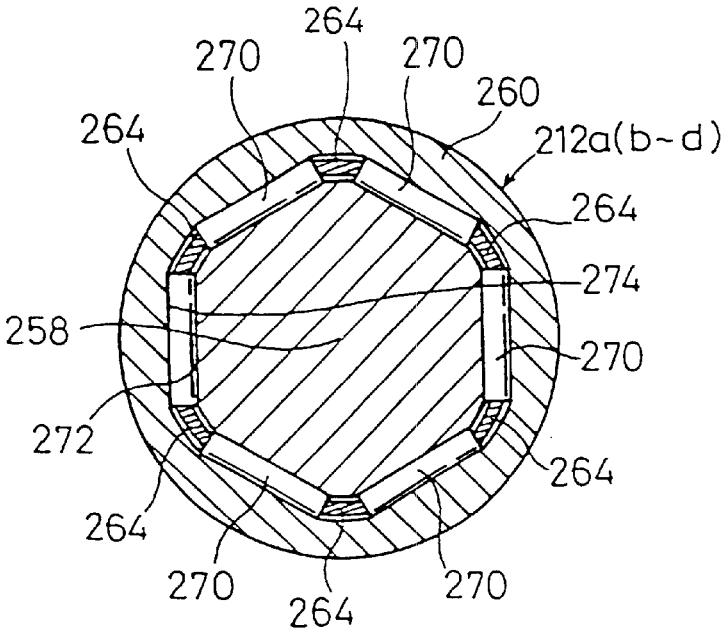
FIG. 19 shows a cross-sectional view taken along a line XIX—XIX shown in FIG. 18.

The guide ring 264 includes a plurality of arrays of holes 268 which are formed substantially in parallel to the axial direction. Substantially columnar rolling members 270 are arranged rollably in the holes 268. As shown in FIG. 19, flat first rolling surfaces 272, which extend along the axial direction and which are formed in a plurality of arrays substantially in parallel to one another, are formed on the outer circumferential surface of the main post body 258. On the other hand, flat second rolling surfaces 274, which are opposed to the first rolling surfaces 272, are formed on the inner wall surface of the cover member 260.

In this arrangement, the rolling members 270 roll in a state of making line-to-line contact with the first rolling surfaces 272 and the second rolling surfaces 274 respectively. Accordingly, the cover member 260 connected to the elevator unit 250 and the guide ring 264 engaged with the cover member 260 are displaced in an integrated manner in the axial direction of the main post body 258.

Alternatively, the rolling members 270 may not be formed in the holes 268 of the guide ring 264. It is also preferable that the guide ring 264 is formed to surround the outer circumferential surface of the main post body 258, and the guide ring 264 is allowed to perform relative sliding displacement while making surface-to-surface contact with the main post body 258.

The forging die 210 according to the second embodiment of the present invention is basically constructed as described above. Next, its operation, function, and effect will be explained. Explanation will be made below for an illustrative case in which an outer cup for constructing a constant velocity universal Joint is forged to obtain a forged product.

At first, explanation will be made for the assembling step for the lower die section for constructing the forging die 210.

The third insert member 217, the second insert member 215, and the first insert member 213 are successively inserted along the axial direction of the hole of the forcible insertion ring 220. In this procedure, the annular projection 219 of the forcible insertion ring 220 is fitted to the annular recess 221 of the third insert member 217. Accordingly, the downward displacement of the third insert member 217 is regulated, and the components are positioned in the hole of the forcible insertion ring 220 (see FIG. 16).

The outer diameter of each of the first to third insert members 213, 215, 217 is designed to be slightly larger than the inner diameter of the hole of the forcible insertion ring 220. Therefore, the hole of the forcible insertion ring 220 is heated and expanded by using an unillustrated heating means, and the first to third insert members 213, 215, 217 are fitted into the hole of the forcible insertion ring 220 by means of the shrinkage fitting.

Subsequently, the lower die 228 and the upper die 226 are successively inserted along the axial direction of the holes of the first to third insert members 213, 215, 217. In this procedure, the inner circumference of the third insert member 217 is fitted to the annular recess 225 which is formed on the outer circumferential surface of the lower die 228. Accordingly, the downward displacement of the lower die 228 is regulated, and the components are installed in the state of being positioned (see FIG. 16). The lower die 228 is forcibly inserted strongly into the holes of the second and third insert members 215, 217.

Further, the first ring member 234 is installed, which is engaged with the upper surfaces of the upper die 226 and the first insert member 213. The second ring member 236 is externally fitted to the first ring member 234. Accordingly, the tapered surface 238, which is formed on the second ring member 236, slidably contacts with the inverse tapered surface 240 which is formed on the first ring member 234. Thus, the force acts to press the first ring member 234 in the downward direction. The pressing force increases the surface pressure at the joining surface between the upper die 226 and the lower die 228, and hence it is possible to avoid any occurrence of burr.

In this procedure, the upper die 226, the lower die 228, the first to third insert members 213, 215, 217, and the other components are assembled in an integrated manner in the state in which the punch 230 externally fitted with the guide sleeve 254 is inserted into the hole 232 of the first ring member 234. Thus, the punch 230 is positioned with respect to the cavity 224 which is formed by the upper die 226 and the lower die 228. The assembling step for the lower die section is completed as described above.

Next, explanation will be made for the forging steps for the forging material.

The primary forging process is applied to a columnar billet 84 as shown in FIG. 5 by using an unillustrated die apparatus to thereby obtain a primary forged product 86 having different diameters of those divided respectively by an intermediate step section as shown in FIG. 6. Subsequently, the preliminary forming process is applied to the primary forged product 86 (see FIG. 7), and then the secondary forging process is performed by using another unillustrated die apparatus. Thus, the secondary formed product 52, which is composed of a cup section 88 and a shaft section 90 as shown in FIG. 8, is obtained.

The forging die 210 according to this embodiment is used for the secondary formed product 52 as a forging material to which the tertiary forging process is further applied.

At first, the following preparatory operation is performed. That is, it is assumed that the punch 230 is previously positioned with respect to the cavity 224 which is formed by the upper die 226 and the lower die 228 in the assembling step as described above.

The secondary formed product 52 as the forging material is charged in the cavity 224 in a state in which the punch 230 is arranged at an unillustrated raised position. The punch 230 is lowered integrally with the elevator unit 250 joined to the ram (not shown) in accordance with the driving action of the unillustrated mechanical press to give the state shown in FIG. 14. Thus, the forging process is started.

When the punch 230 is lowered integrally with the elevator unit 250, any unbalanced load in the transverse direction is preferably absorbed by the plurality of (for example, four of) guide means 212*a* to 212*d* which are provided between the elevator unit 250 and the first die holder 214. Accordingly, the punch 230 is smoothly inserted under the pressure into the center of the first ring member 234.

When the forging process is started, the guide sleeve 254, which is externally fitted to the part of the outer circumferential surface of the punch 230, advances in accordance with the guiding action of an annular guide groove (not shown) formed at the upper end of the hole 232 of the first ring member 234, and the punch 230 is further lowered. Accordingly, the punch 230 and the guide sleeve 254 are displaced in an integrated manner in a state of being forcibly inserted into the hole 232 of the first ring member 234.

Figure 15:
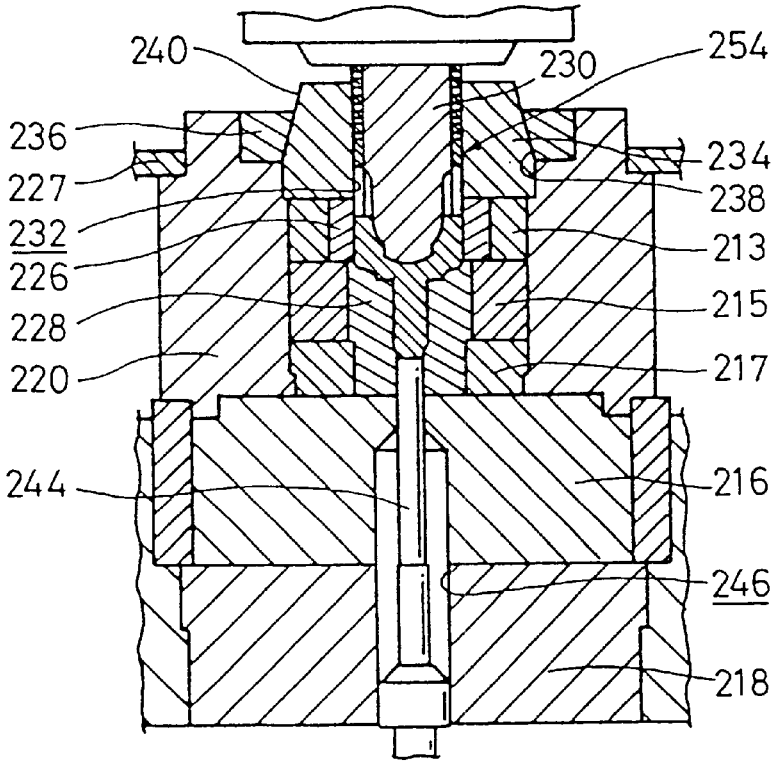
FIG. 15 illustrates the operation depicting a state in which the forging process is completed after a punch is lowered from a forging start position shown in FIG. 14.

Thus, the punch 230 is lowered, and it arrives at the forging end position shown in FIG. 15 from the forging start position shown in FIG. 14. Accordingly, the forging is applied to the forging material by the aid of the punch 230, the lower die 228, and the upper die 226. The forging material is subjected to plastic flow along with the shape of the cavity 224.

After completion of the forging process as described above, the punch 230 is raised to the predetermined position integrally with the elevator unit 250 connected to the ram (not shown) in accordance with the driving action of the unillustrated mechanical press. Accordingly, the punch 230 and the guide sleeve 254 are separated from the hole 232 of the first ring member 234, giving a waiting state for the next step. The forged product 284 (see FIG. 21) is taken out in accordance with the displacement action of the knockout pin 244.

In the second embodiment, the stress acts on the portion at which the stress is concentrated on the die when the forging process is performed, i.e., the inner wall surface 223 of the lower die 228 corresponding to the joint portion of the cup section 286 and the shaft section 288 of the outer cup obtained as the forged product 284. However, the lower die 228 is externally fitted by the annular second insert member 215 which is composed of the harder material, and thus the rigidity is secured in the radial direction substantially perpendicular to the axis. Accordingly, it is possible to suppress the strain (deformation) of the die which would be otherwise caused by the stress.

Therefore, even when the forging process is continuously performed for a long period of time by using the forging die 210 according to the second embodiment, then the service life is prolonged as compared with the die concerning the conventional technique, and it is possible to improve the durability. As a result, it is possible to reduce the cost of the die.

When the pressurizing force is applied to the forging material, the guide sleeve 254, which is externally fitted to the punch 230, is in the state of being forcibly inserted into the hole 232 of the first ring member 234. Accordingly, the punch 230 is lowered while maintaining the forcible inserted state.

Therefore, in the second embodiment, the pressurizing force is applied to the forging material in the state in which the punch 230 is forcibly inserted by the aid of the guide sleeve 254 into the hole 232 of the first ring member 234. The punch 230 does not cause any centering deviation in the transverse direction. Therefore, as shown in FIG. 21, it is possible to highly accurately maintain the coaxiality between the axis E of the cup section 286 and the axis F of the shaft section 288 of the outer cup obtained as the forged product 284. In this embodiment, the deflection of the shaft section 288 of the outer cup was successfully suppressed to be, for example, not more than 0.06 mm.

The guide sleeve 254 is made of the metal of the type which is different from that for the first ring member 234. Further, the graphite, which is embedded in the guide sleeve 254, is used to well retain the lubrication characteristic. Thus, it is possible to suppress the occurrence of scuffing on the sliding surfaces of the guide sleeve 254 and the first ring member 234.

The guide sleeve 254 is provided detachably with respect to the punch 230 by the aid of the jig 252. Accordingly, it is advantageous that the guide sleeve 254 can be conveniently exchanged with another new guide sleeve 254.

In addition, for example, the outer circumferential surface of the cup section 286 of the outer cup, which is the attachment site of a pulser (not shown), can be directly ground.

Figure 22:
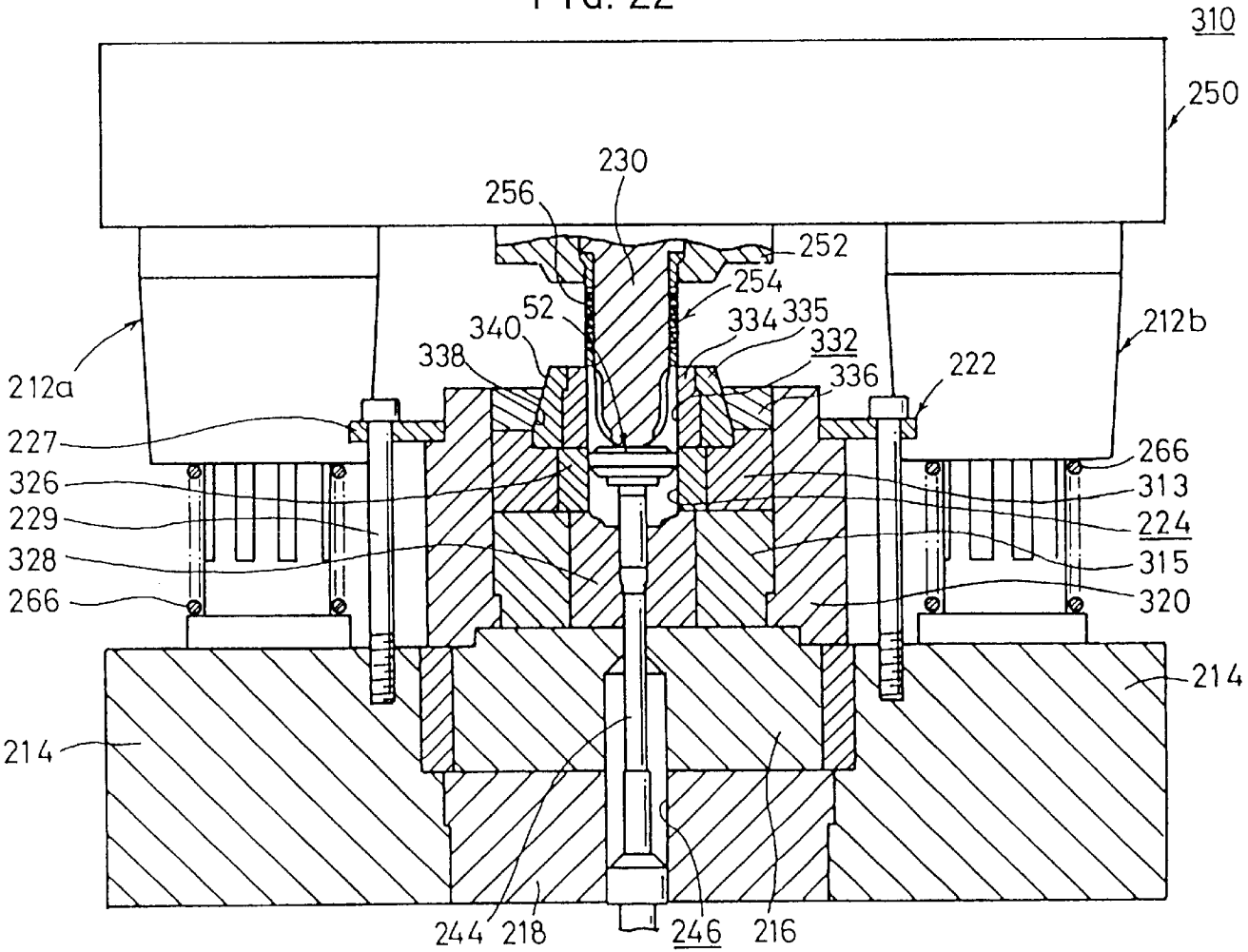
FIG. 22 shows a longitudinal sectional view illustrating a forging die according to a third embodiment of the present invention.
Figure 23:
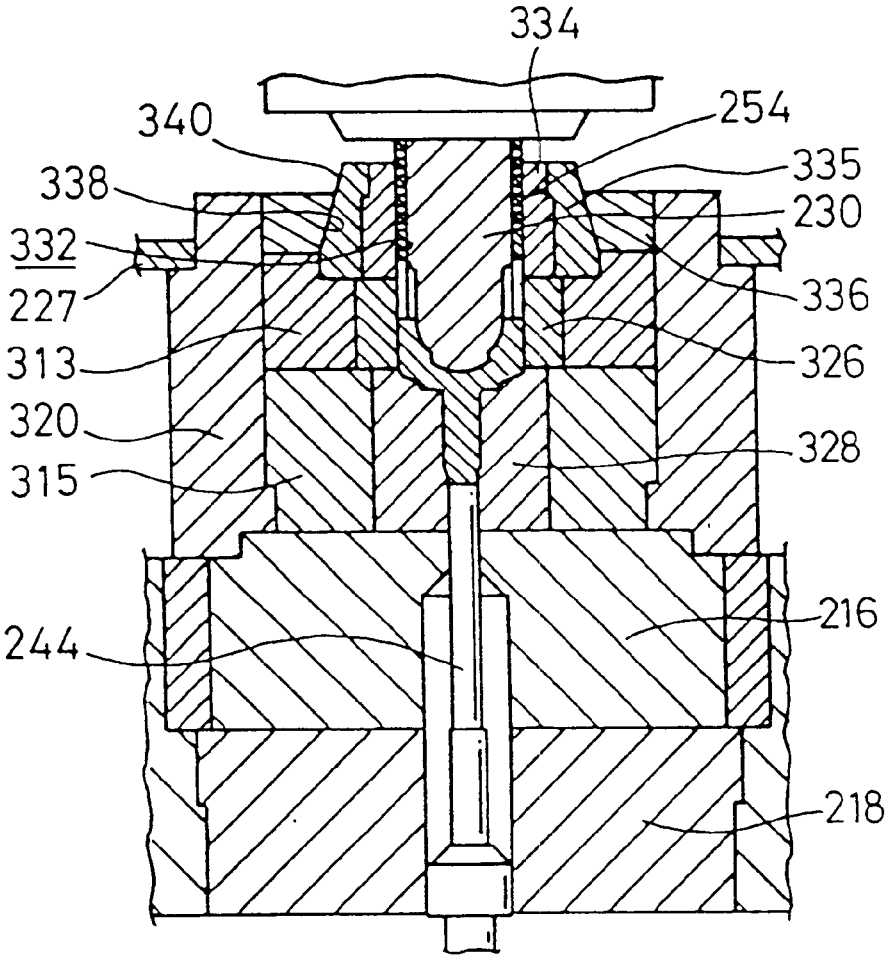
FIG. 23 illustrates the operation depicting a state in which the forging process is completed after a punch is lowered from a forging start position shown in FIG. 22.

Next, a forging die 310 according to a third embodiment of the present invention is shown in FIG. 22.

The forging die 310 includes a forcible insertion ring 320 which is formed to have a substantially cylindrical configuration. A first insert member (first annular member) 313 and a second insert member (second annular member) 315, which are formed as ring members in a divided manner respectively, are integrally joined in the axial direction in the hole of the forcible insertion ring 320 (see FIG. 24). Each of the first and second insert members 313, 315 is made of, for example, a metal material of SNCM 439 (based on JIS) having a Rockwell hardness HRC of about 40.

Figure 25:
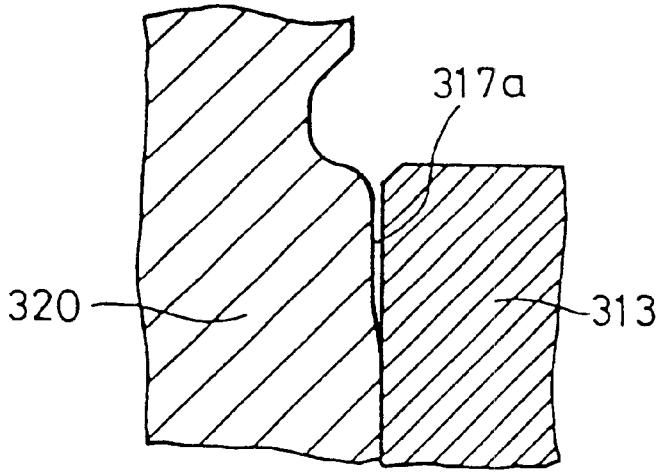
FIG. 25 shows a magnified longitudinal sectional view illustrating a part of G shown in FIG. 24.
Figure 26:
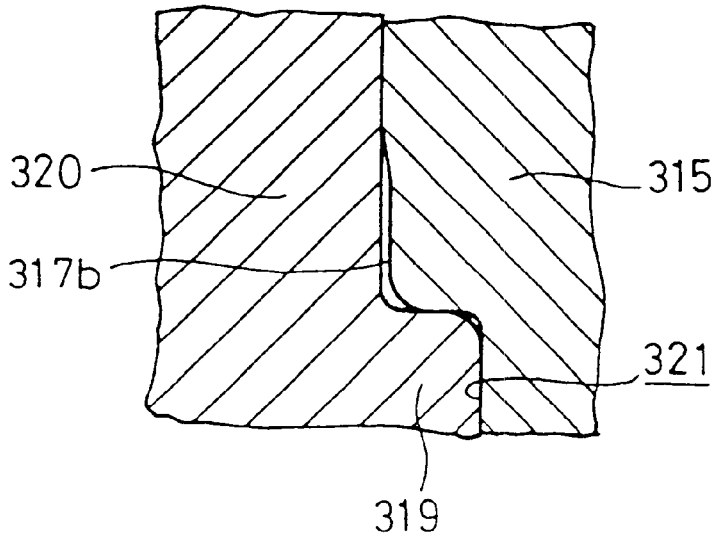
FIG. 26 shows a magnified longitudinal sectional view illustrating a part of H shown in FIG. 24.

As shown in FIGS. 25 and 26, clearances 317*a*, 317*b*, which are available when the first and second insert members 313, 315 are forcibly inserted with ease into the hole of the forcible insertion ring 320, are formed on the upper side of the forcible insertion ring 320 and the lower side of the second insert member 315 respectively.

Figure 24:
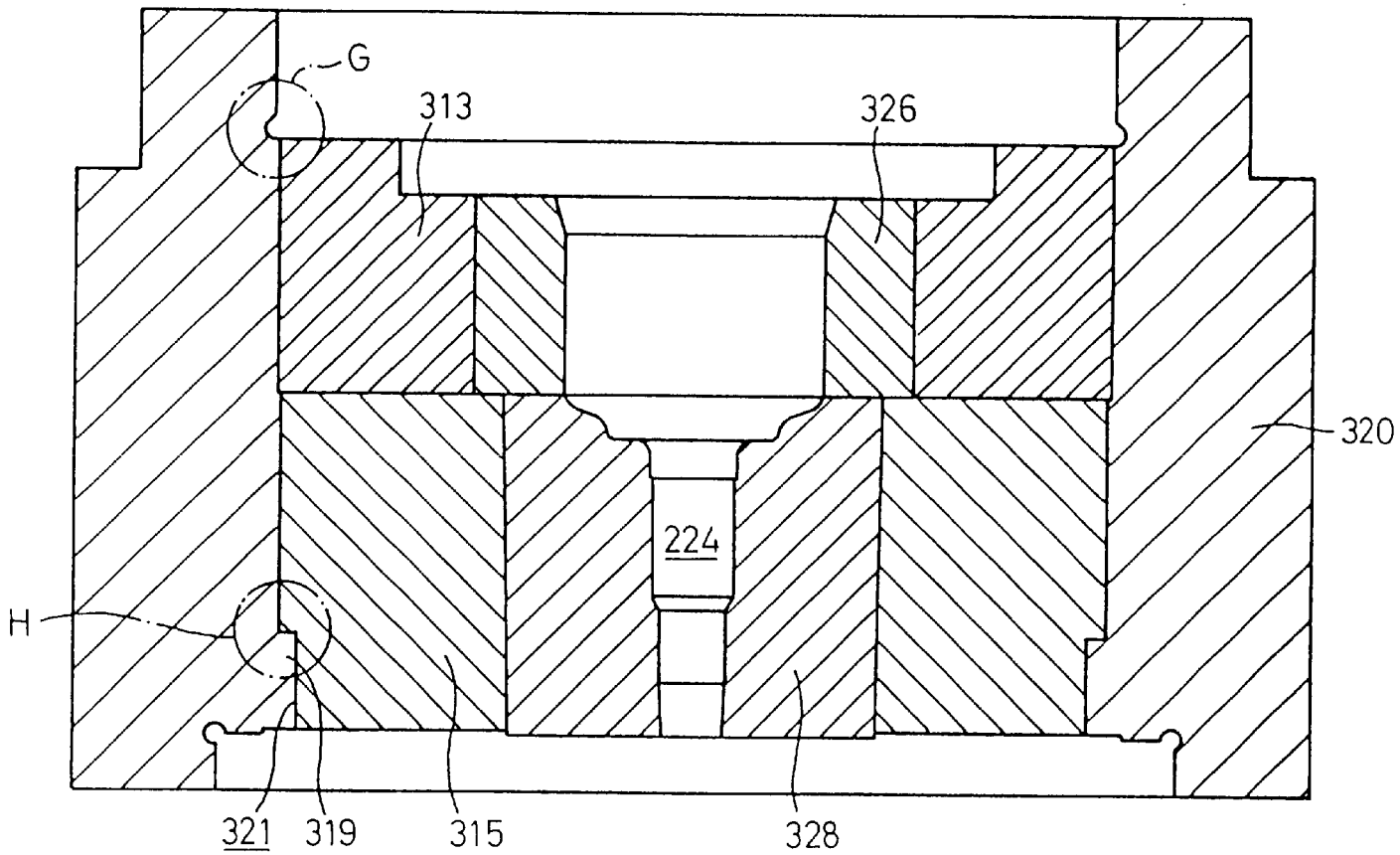
FIG. 24 shows a partial magnified longitudinal sectional view illustrating the forging die shown in FIG. 22.

As shown in FIG. 24, an annular projection 319 is formed at a lower portion of the inner circumferential surface of the forcible insertion ring 320. The annular projection 319 is fitted to an annular recess 321 which is formed on the second insert member 315. Thus, the downward displacement of the second insert member 315 is regulated, and it is positioned in the hole of the forcible insertion ring 320.

An upper die 326 and a lower die 328, which are formed in a divided manner, are joined in an integrated manner along the axial direction at the inside of the first and second insert members 313, 315. A cavity 224 for charging the forging material therein is formed at the inside of the upper die 326 and the lower die 328. The upper die 326 and the lower die 328 function as a die member.

As shown in FIG. 22, a first ring member 334 formed with a hole 332 for forcibly inserting a punch 230 therein, and a second ring member 335 provided integrally with the first ring member 334 are joined to the upper surfaces of the upper die 326 and the first insert member 313. A clamping ring 336 having a large diameter, which is externally fitted to the second ring member 335, is integrally joined to the upper surface of the first insert member 313. Alternatively, it is allowable to use an unillustrated ring member in which the first ring member 334 and the second ring member 335 are integrated into one unit.

In this embodiment, the clamping ring 336 is clamped into the hole of the forcible insertion ring 320. Accordingly, the first ring member 334 and the second ring member 335 are externally fitted by the clamping ring 336. A tapered surface 338, which is formed on the clamping ring 336, slidably contacts with an inverse tapered surface 340 which is formed on the second ring member 335. Thus, the force acts to press the first ring member 334 downwardly.

The forging die 310 according to the third embodiment of the present invention is basically constructed as described above. Next, its operation, function, and effect will be explained.

At first, explanation will be made for the assembling step for the lower die section for constructing the forging die 310.

The second insert member 315 and the first insert member 313 are successively inserted along the axial direction of the hole of the forcible insertion ring 320. In this procedure, the annular projection 319 of the forcible insertion ring 320 is fitted to the annular recess 321 of the second insert member 315. Accordingly, the downward displacement of the second insert member 315 is regulated, and the components are positioned in the hole of the forcible insertion ring 320.

The first and second insert members 313, 315 are forcibly inserted smoothly with ease by the aid of the clearances 317*a*, 317*b* formed on the forcible insertion ring 320 and the second insert member 315 respectively (see FIGS. 25 and 26).

Subsequently, the lower die 328 and the upper die 326 are successively inserted along the axial direction of the holes of the first and second insert members 313, 315. The upper die 326 and the lower die 328 are forcibly inserted strongly into the holes of the first and second insert members 313, 315.

Further, the first ring member 334 and the second ring member 335 are installed, which are engaged with the upper surfaces of the upper die 326 and the first insert member 313. The clamping ring 336 is externally fitted to the second ring member 335. Accordingly, the tapered surface 338, which is formed on the clamping ring 336, slidably contacts with the inverse tapered surface 340 which is formed on the second ring member 335. Thus, the force acts to press the first ring member 334 in the downward direction. The pressing force increases the surface pressure at the joining surface between the upper die 326 and the lower die 328, and hence it is possible to avoid any occurrence of burr.

In this procedure, the upper die 326, the lower die 328, the first and second insert members 313, 315, and the other components are assembled in an integrated manner in the state in which the punch 230 externally fitted with the guide sleeve 254 is inserted into the hole 332 of the first ring member 334. Thus, the punch 230 is positioned with respect to the cavity 224 which is formed by the upper die 326 and the lower die 328. The assembling step for the lower die section is completed as described above.

In the third embodiment, the first and second insert members 313, 315 are forcibly inserted with ease into the hole of the forcible insertion ring 320. Further, the structure is formed to be simple. Accordingly, the die, which has been once assembled, can be disassembled easily and conveniently. Thus, it is possible to improve the dividing performance. Therefore, the maintenance operation can be easily performed, and the maintenance performance is improved.

In the third embodiment, when the forging process is performed, even if the stress is applied radially outwardly to the upper die 326 and the lower die 328, then the first and second insert members 313, 315, which are forcibly inserted with ease into the hole of the forcible insertion ring 320, are displaced by a minute distance radially outwardly. Thus, the stress can be preferably absorbed.

Therefore, the strain of the die resulting from the stress is suppressed, and thus it is possible to prolong the service life of the die. Even when the die is worn due to the secular change as a result of the use for a long term, it is enough that only the lower die 328, on which the stress is concentrated, is exchanged with a new lower die 328. Therefore, it is possible to reduce the cost of the die.

Further, the third embodiment adopts the simple structure in which the upper die 326 and the lower die 328 are externally fitted by the first and second insert members 313, 315. Thus, it is possible to further reduce the cost of the die.

The other construction, function, and effect are the same as those of the second embodiment described above, detailed explanation of which is omitted.

Figure 27:
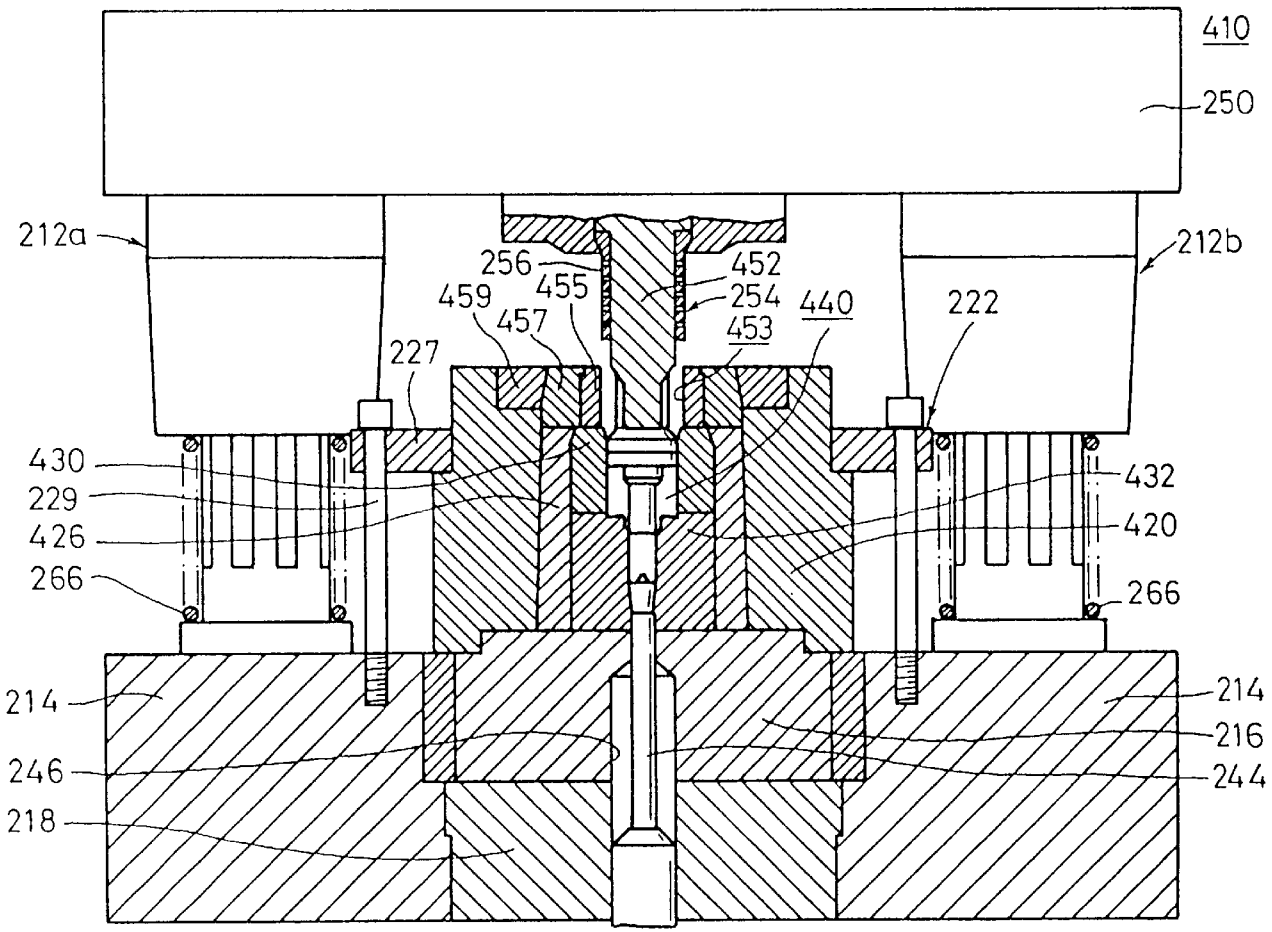
FIG. 27 shows a longitudinal sectional view illustrating a forging die according to a fourth embodiment of the present invention.

Next, a forging die 410 according to a fourth embodiment of the present invention is shown in FIG. 27.

The forging die 410 includes a forcible insertion ring 420 which is formed to have a substantially cylindrical configuration. A cylindrical sleeve member (annular member) 426 is forcibly inserted into a hole 424 of the forcible insertion ring 420. An upper die 430 and a lower die 432, which are formed as ring members in a divided manner respectively, are forcibly inserted into the hole 428 of the sleeve member 426 in a state of being integrally joined in the axial direction (see FIG. 28). The upper die 430 and the lower die 432 function as a die member.

Figure 28:
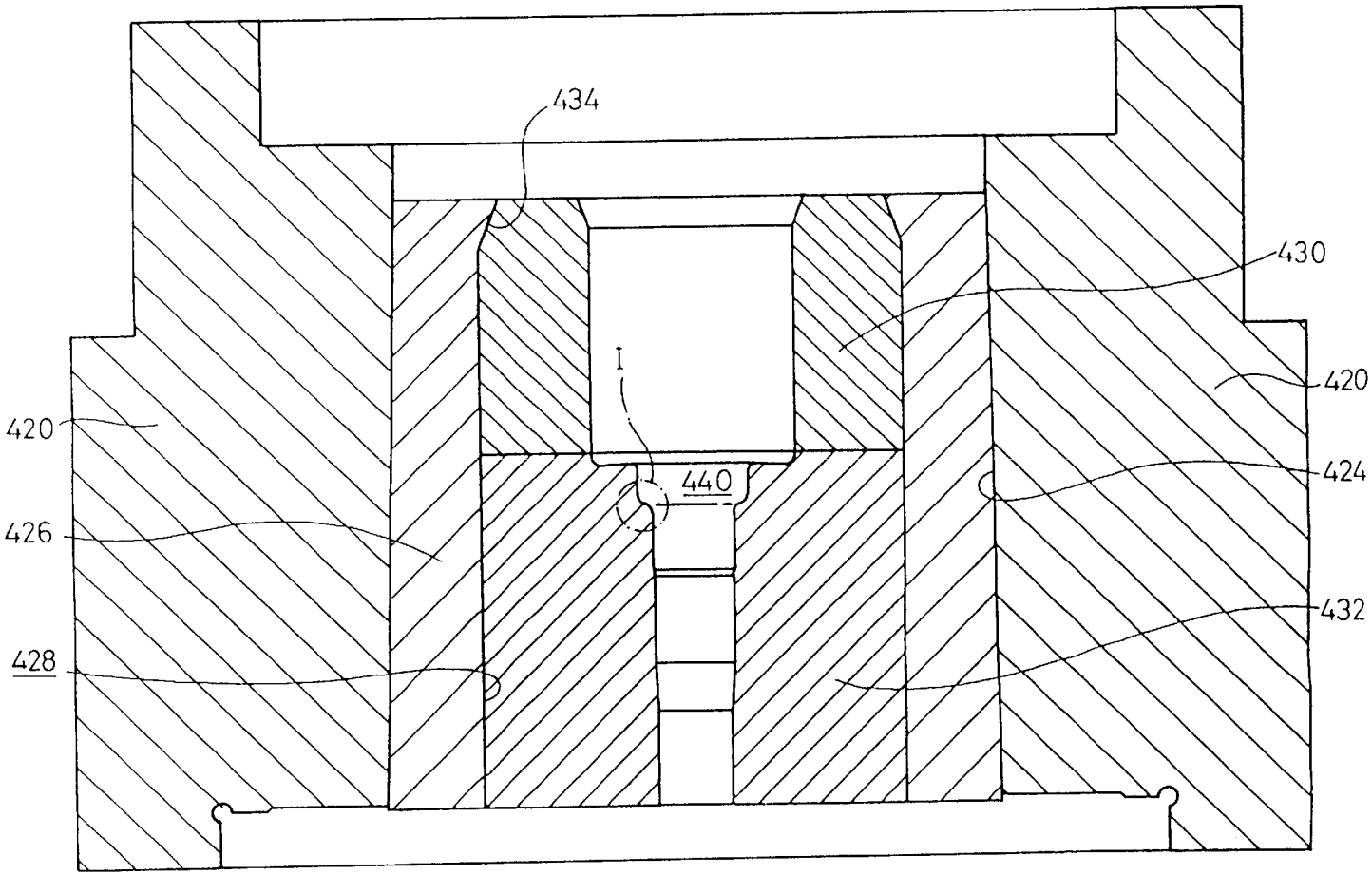
FIG. 28 shows a partial magnified longitudinal sectional view illustrating the forging die shown in FIG. 27.

As shown in FIG. 28, a tapered surface 434, which has its inner diameter gradually decreasing upwardly, is formed on the upper side of the hole 428 of the sleeve member 426. The tapered surface 434 presses the upper die 430 downwardly. Thus, the tapered surface 434 functions to avoid any occurrence of burr by increasing the surface pressure at the joined surface between the upper die 430 and the lower die 432.

Figure 29:
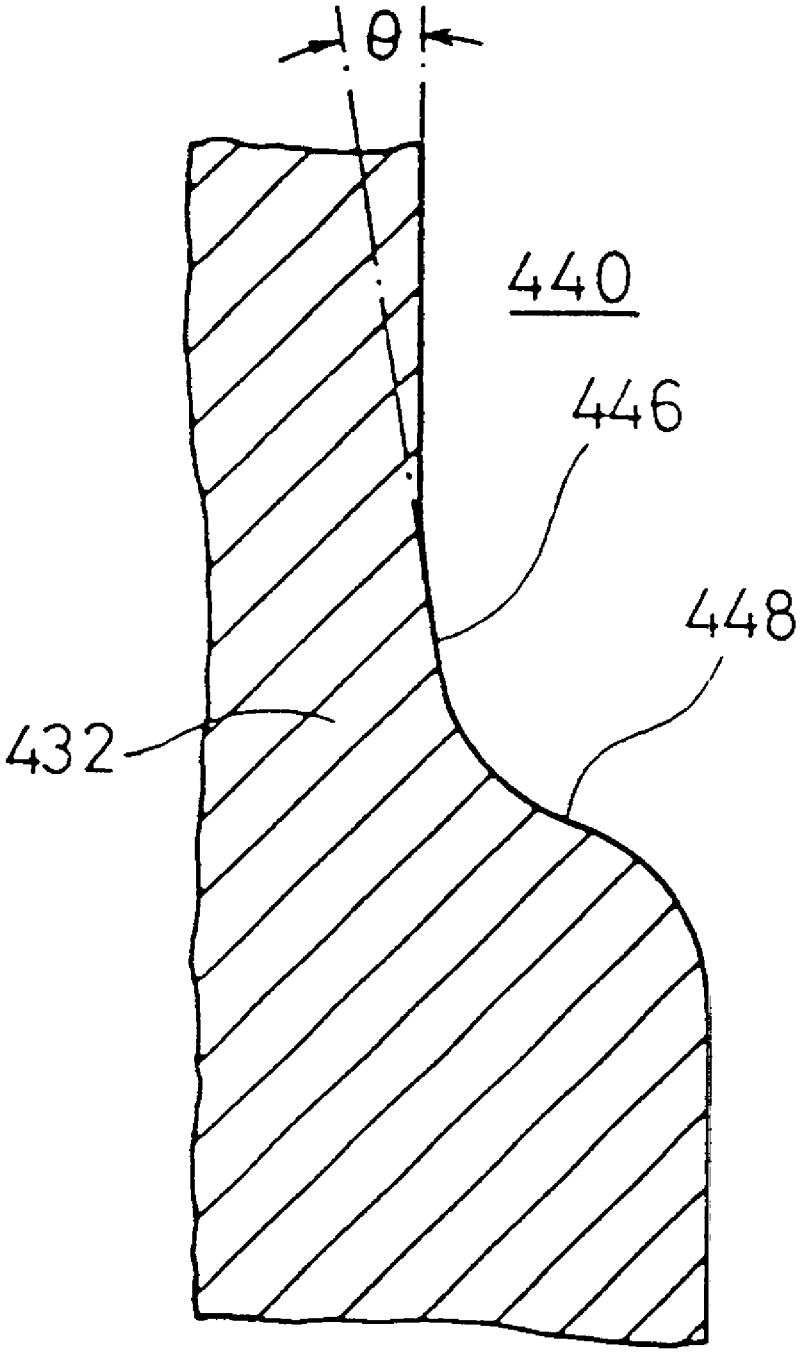
FIG. 29 shows a magnified longitudinal sectional view illustrating a part of I shown in FIG. 28.

A cavity 440 for charging the forging material therein is formed at the inside of the upper die 430 and the lower die 432. As shown in FIG. 29, an inclined surface 446, which is inclined by a predetermined angle θ with respect to the vertical plane, is formed on the inner wall surface of the lower die 432 for forming the cavity 440, i.e., at a portion corresponding to a step section 444 of a forged product 442 (see FIG. 33). A curved section 448, which has a circular arc-shaped cross section with a large radius of curvature, is continuously formed under the inclined surface 446. The inclined surface 446 and the curved section 448 function as a stress-suppressing mechanism. In FIG. 29, the predetermined angle θ of the inclined surface 446 is set to be about 15 degrees.

As shown in FIG. 27, a first ring member 455 formed with a hole 453 for forcibly inserting a punch 452 therein, and a second ring member 457 formed integrally with the first ring member 455 are joined to the upper surfaces of the upper die 430 and the sleeve member 426. A clamping ring 459 having a large diameter, which is externally fitted to the second ring member 457, is integrally joined to the upper surface of the forcible insertion ring 420. Alternatively, it is allowable to use an unillustrated ring member in which the first ring member 455 and the second ring member 457 are integrated into one unit.

In this embodiment, the clamping ring 459 is clamped into the hole of the forcible insertion ring 420. Accordingly, the first ring member 455 and the second ring member 457 are externally fitted by the clamping ring 459. A tapered surface, which is formed on the clamping ring 459, slidably contacts with an inverse tapered surface which is formed on the second ring member 457. Thus, the force acts to press the first ring member 455 downwardly.

The forging die 410 according to the fourth embodiment of the present invention is basically constructed as described above. Next, its operation, function, and effect will be explained. Explanation will be made below for an illustrative case in which an outer cup for constructing a constant velocity universal joint is forged to obtain a forged product.

At first, explanation will be made for the forging steps for the forging material.

Figure 30:
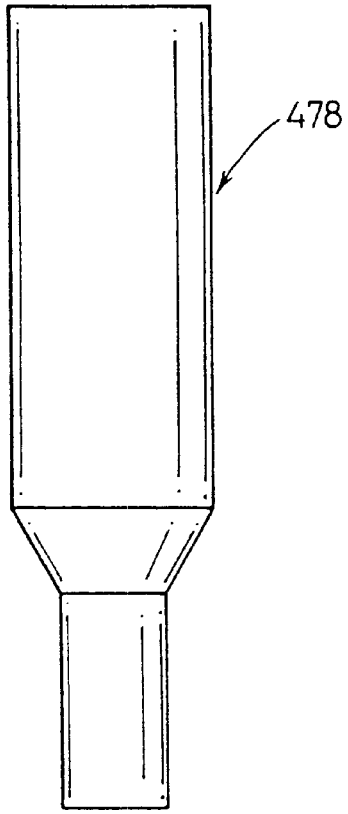
FIG. 30 illustrates a production step of an outer cup for constructing a constant velocity universal joint.
Figure 31:
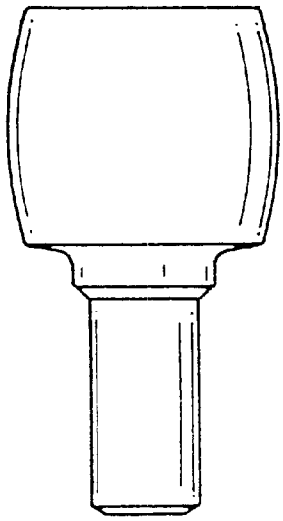
FIG. 31 illustrates a production step of the outer cup for constructing the constant velocity universal joint.
Figure 32:
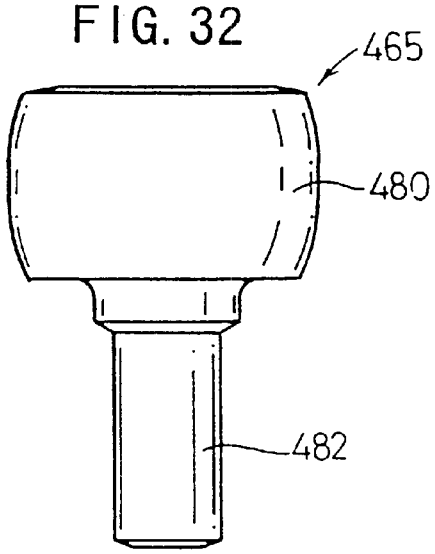
FIG. 32 shows a front view illustrating a forging material to be charged in a cavity of the forging die shown in FIG. 27.

The primary forging process is applied to a columnar billet (not shown) by using an unillustrated die apparatus to thereby obtain a primary forged product 478 having different diameters of those divided respectively by an intermediate step section as shown in FIG. 30. Subsequently, the preliminary forming process is applied to the primary forged product 478 (see FIG. 31), and then the secondary forging process is performed by using another unillustrated die apparatus. Thus, the secondary formed product 465, which is composed of a cup section 480 and a shaft section 482 as shown in FIG. 32, is obtained.

The forging die 410 according to the fourth embodiment is used for the secondary formed product 465 as a forging material to which the tertiary forging process is further applied. The following preparatory operation is performed. That is, it is assumed that the punch 452 is previously positioned with respect to the cavity 440 which is formed by the upper die 430 and the lower die 432.

The secondary formed product 465 as the forging material is charged in the cavity 440 in a state in which the punch 452 is arranged at an unillustrated raised position. The punch 452 is lowered integrally with the elevator unit 250 joined to the ram (not shown) in accordance with the driving action of the unillustrated mechanical press to give the state shown in FIG. 27. Thus, the forging process is started.

When the forging process is started, the guide sleeve 254, which is externally fitted to the part of the outer circumferential surface of the punch 452, advances in accordance with the guiding action of an annular guide groove (not shown) formed at the upper end of the hole 453 of the first ring member 455, and the punch 452 is further lowered. Accordingly, the punch 452 and the guide sleeve 254 are displaced in an integrated manner in a state of being forcibly inserted into the hole 453 of the first ring member 455.

Thus, the punch 452 is lowered, and it arrives at the forging end position from the forging start position shown in FIG. 27. Accordingly, the forging is applied to the forging material by the aid of the punch 452, the lower die 432, and the upper die 430. The forging material is subjected to plastic flow along with the shape of the cavity 440.

After completion of the forging process as described above, the punch 452 is raised to the predetermined position integrally with the elevator unit 250 connected to the ram (not shown) in accordance with the driving action of the unillustrated mechanical press. Accordingly, the punch 452 and the guide sleeve 254 are separated from the hole 453 of the first ring member 455, giving a waiting state for the next step. The forged product 442 (see FIG. 33) is taken out in accordance with the displacement action of the knockout pin 244.

Explanation will now be made for the stress which is generated when the forged product 442 is taken out of the upper die 430 and the lower die 432 by the aid of the knockout pin 244.

Figure 34:
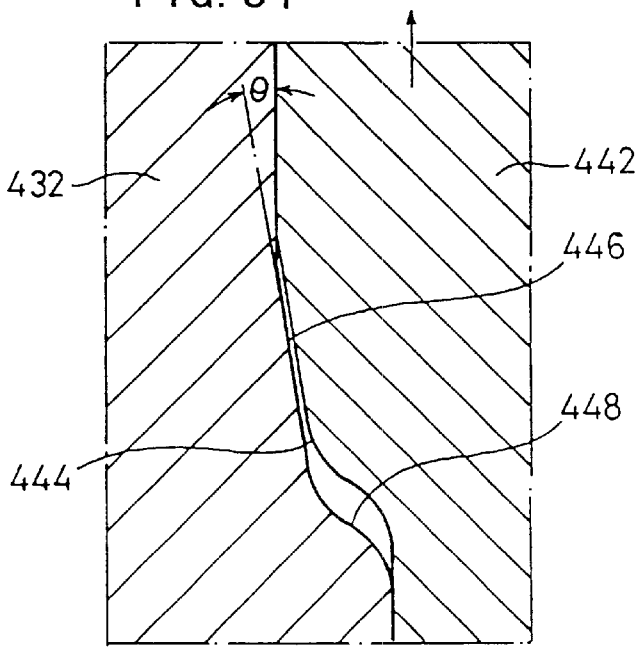
FIG. 34 shows a magnified sectional view with partial omission for illustrating the stress generated when the forged product is taken out by using a lower die according to the fourth embodiment of the present invention.
Figure 35:
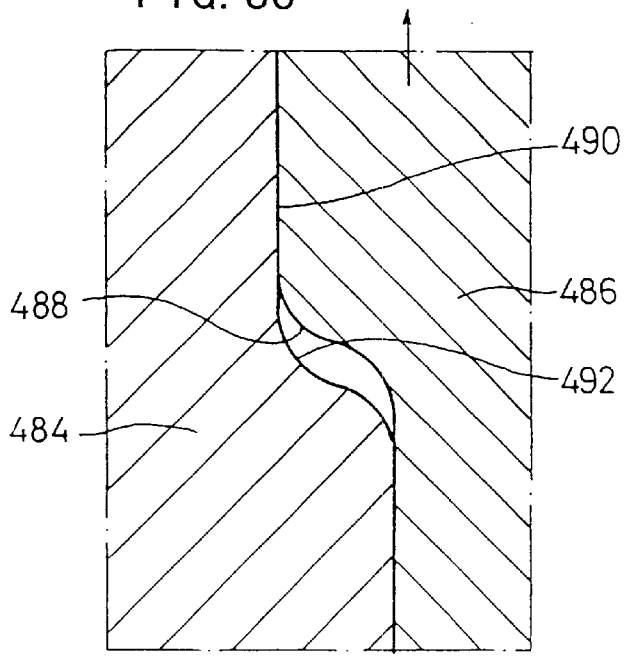
FIG. 35 shows a magnified sectional view with partial omission for illustrating the stress generated when a forged product is taken out by using a lower die concerning Comparative Example.

FIG. 34 shows a magnified longitudinal sectional view illustrating a state in which the step section 444 of the forged product 442 is separated from the inner wall surface of the lower die 432 according to the fourth embodiment by being pressed upwardly by the knockout pin 244. FIG. 35 shows a magnified longitudinal sectional view illustrating a state in which the step section 488 of the forged product 486 is separated from an inner wall surface of a lower die 484 concerning Comparative Example.

In Comparative Example shown in FIG. 35, the inner wall surface 490 of the lower die 484, which corresponds to the step section 488 of the forged product 486, is formed along the vertical plane. When the forged product 486 is pressed upwardly (in the direction indicated by the arrow) by the knockout pin 244, the following inconvenience arises. That is, the stress is concentrated on the predetermined position 492 of the inner wall surface 490 of the lower die 484 corresponding to the step section 488, resulting in occurrence of any crack.

On the contrary, in the fourth embodiment shown in FIG. 34, the inclined surface 446, which is inclined by the predetermined angle with respect to the vertical plane, is formed at the portion corresponding to the step section 444 of the forged product 442. Further, the curved section 448 is formed, which has the circular arc-shaped configuration and which continues to the inclined surface 446.

Therefore, in the fourth embodiment, when the forged product 442 is pressed upwardly by the knockout pin 244, then the plastic strain, which is generated between the outer circumferential surface of the step section 444 of the forged product 442 and the inner wall surface of the lower die 432, is dispersed, and thus the stress concentration is mitigated. In other words, the contact surface pressure, which is generated between the outer circumferential surface of the step section 444 of the forged product 442 and the inner wall surface of the lower die 432, is deflected from the predetermined position 492. Thus, the stress, which is applied to the inner wall surface of the lower die 432, can be dispersed, and the stress can be suppressed. As a result, the inner wall surface of the lower die 432 is prevented from occurrence of any crack. Therefore, the durability of the die can be improved, and the cost of the die can be reduced.

Further, the fourth embodiment is constructed as follows. That is, when the pressurizing force is applied to the forging material, the guide sleeve 254, which is externally fitted to the punch 452, is in the state of being forcibly inserted into the hole 453 of the first ring member 455. The punch 452 is lowered while maintaining the forcibly inserted state described above.

Figure 33:
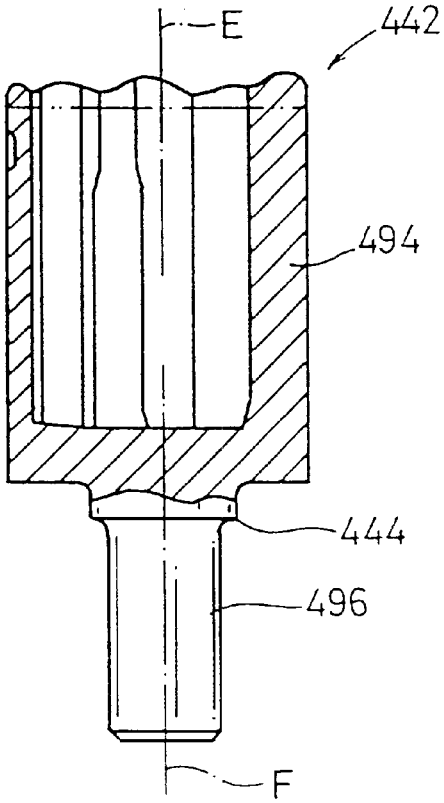
FIG. 33 shows a partial longitudinal sectional view illustrating a forged product forged by using the forging die shown in FIG. 27.

Therefore, the pressurizing force is applied to the forging material in the state in which the punch 452 is forcibly inserted into the hole 453 of the first ring member 455 by the aid of the guide sleeve 254. The punch 452 does not cause any positional deviation in the transverse direction. Accordingly, as shown in FIG. 33, it is possible to highly accurately maintain the coaxiality between the axis E of the cup section 494 and the axis F of the shaft section 496 of the outer cup obtained as the forged product 442. In this embodiment, the deflection of the shaft section 496 of the outer cup was successfully suppressed to be, for example, not more than 0.06 mm.

What is claimed is:

1. A forging die incorporated with a forging apparatus for applying a pressurizing force to a forging material charged in a cavity to perform forging, comprising:

a die member for forming said cavity;

a plurality of annular members externally fitted to said die member and formed in a divided manner in an axial direction; and a cylindrical member externally fitted to said plurality of annular members, wherein:

a hardness of said annular member corresponding to a portion at which a stress is concentrated on said die member is set to be larger than hardnesses of the other annular members.

2. The forging die incorporated with said forging apparatus according to claim 1, wherein said plurality of annular members are composed of first to third insert members, and a hardness of said second insert member arranged at an intermediate position in said axial direction is set to be larger than hardnesses of said adjacent first and third insert members.

3. A forging die comprising:

a die member formed with a cavity for charging a forging material therein;

a plurality of annular members externally fitted to said die member and formed in a divided manner in an axial direction;

a cylindrical member externally fitted to said plurality of annular members;

a punch for applying a pressurizing force to said forging material charged in said cavity;

a sleeve member installed to surround a part of an outer circumference of said punch, for making displacement together with said punch; and a ring member joined integrally with said die member and formed with a hole for forcibly inserting said sleeve member thereinto when said punch applies said pressurizing force to said forging material, wherein:

a hardness of said annular member corresponding to a portion at which a stress is concentrated on said die member is set to be larger than hardnesses of the other annular members.

4. A forging die incorporated with a forging apparatus for applying a pressurizing force to a forging material charged in a cavity to perform forging, comprising:

an upper die and a lower die for forming said cavity;

a first annular member and a second annular member externally fitted to said upper die and said lower die respectively and formed in a divided manner in an axial direction; and a cylindrical member externally fitted to said first annular member and said second annular member, wherein:

said first annular member and said second annular member are forcibly inserted into a hole of said cylindrical member so that they are displaceable by a minute distance in a radially outward direction substantially perpendicular to said axial direction.

5. The forging die incorporated with said forging apparatus according to claim 4, wherein a clearance, which is available for said forcible insertion, is formed between said cylindrical member and said first annular member and said second annular member.

6. A forging die comprising:

an upper die and a lower die for forming a cavity;

a first annular member and a second annular member externally fitted to said upper die and said lower die respectively and formed in a divided manner in an axial direction;

a cylindrical member externally fitted to said first annular member and said second annular member;

a punch for applying a pressurizing force to a forging material charged in said cavity;

a sleeve member installed to surround a part of an outer circumference of said punch, for making displacement integrally with said punch; and a ring member joined integrally with said die member and formed with a hole for forcibly inserting said sleeve member therein when said punch applies said pressurizing force to said forging material, wherein:

said first annular member and said second annular member are forcibly inserted into a hole of said cylindrical member so that they are displaceable by a minute distance in a radially outward direction substantially perpendicular to said axial direction.

7. A forging die incorporated with a forging apparatus for applying a pressurizing force to a forging material charged in a cavity to perform forging, comprising:

a die member for forming said cavity;

an annular member externally fitted to said die member; and a cylindrical member formed to have a wall thickness thicker than that of said annular member and externally fitted to said annular member and a stress-suppressing mechanism for suppressing a stress applied when a forged product is withdrawn from said cavity formed on an inner wall surface of said die member, said forged product having a step section, and said stress-suppressing mechanism being provided on said inner wall surface of said die member corresponding to said step section of said forged product, wherein: said stress-suppressing mechanism includes an inclined surface formed on said inner wall surface of said die member and inclined by a predetermined angle with respect to a vertical plane, and a curved section having a circular arc-shaped configuration contiguous with said inclined surface.

* * * * *